US007897196B2

(12) United States Patent
Cedrone et al.

(10) Patent No.: US 7,897,196 B2
(45) Date of Patent: Mar. 1, 2011

(54) ERROR VOLUME SYSTEM AND METHOD FOR A PUMP

(75) Inventors: James Cedrone, Braintree, MA (US); George Gonnella, Pepperell, MA (US)

(73) Assignee: Entegris, Inc., Billerica, MA (US)

( * ) Notice: Subject to any disclaimer, the term of this patent is extended or adjusted under 35 U.S.C. 154(b) by 632 days.

(21) Appl. No.: 11/602,507

(22) Filed: Nov. 20, 2006

(65) Prior Publication Data

US 2007/0125796 A1 Jun. 7, 2007

Related U.S. Application Data

(60) Provisional application No. 60/742,304, filed on Dec. 5, 2005.

(51) Int. Cl.
*B67D 5/30* (2006.01)

(52) U.S. Cl. ..... 427/8; 436/50; 436/180; 427/140; 427/355; 118/300; 118/323; 118/683

(58) Field of Classification Search ..... 427/8
See application file for complete search history.

(56) References Cited

U.S. PATENT DOCUMENTS

| | | | |
|---|---|---|---|
| 269,626 | A | 12/1882 | Bodel et al. |
| 826,018 | A | 7/1906 | Concoff |
| 1,664,125 | A | 3/1928 | Lowrey |
| 2,153,664 | A | 4/1939 | Freedlander |
| 2,215,505 | A | 9/1940 | Hollander |
| 2,328,468 | A | 8/1943 | Laffly |
| 2,457,384 | A | 12/1948 | Krenz |
| 2,631,538 | A | 3/1953 | Johnson |
| 2,673,522 | A | 3/1954 | Dickey |
| 2,757,966 | A | 8/1956 | Samiran |
| 3,072,058 | A | 1/1963 | Christopher et al. |
| 3,227,279 | A | 1/1966 | Bockelman |
| 3,327,635 | A | 6/1967 | Sachnik |
| 3,623,661 | A | 11/1971 | Wagner |
| 3,741,298 | A | 6/1973 | Canton |
| 3,895,748 | A | 7/1975 | Klingenberg |
| 3,954,352 | A | 5/1976 | Sakai |
| 4,023,592 | A | 5/1977 | Patzke |
| 4,093,403 | A | 6/1978 | Schrimpf |
| 4,420,811 | A | 12/1983 | Tarnay et al. |
| 4,452,265 | A | 6/1984 | Lonnebring |
| 4,475,818 | A | 10/1984 | Bialkowski |
| 4,483,665 | A | 11/1984 | Hauser |
| 4,541,455 | A | 9/1985 | Hauser |
| 4,597,719 | A | 7/1986 | Tano |

(Continued)

FOREIGN PATENT DOCUMENTS

| | | |
|---|---|---|
| AU | B-78872/87 | 4/1988 |

(Continued)

OTHER PUBLICATIONS

International Search Report and Written Opinion issued in PCT/US07/05377 mailed Jun. 4, 2008.

(Continued)

*Primary Examiner* — Michael Kornakov
*Assistant Examiner* — Alexander Weddle
(74) *Attorney, Agent, or Firm* — Sprinkle IP Law Group

(57) ABSTRACT

A pumping system that accurately dispenses fluid using a pump, including reducing the error in the amount of a fluid a pump dispenses by correcting for the compliance of a dispense system.

25 Claims, 12 Drawing Sheets

U.S. PATENT DOCUMENTS 4,597,721 A 7/1986 Santefort
4,601,409 A 7/1986 DiRegolo
4,614,438 A 9/1986 Kobayashi
4,671,545 A 6/1987 Miyazaki
4,690,621 A 9/1987 Swain
4,705,461 A 11/1987 Clements
4,739,923 A 4/1988 Tsutsui et al.
4,797,834 A 1/1989 Honganen et al.
4,808,077 A 2/1989 Kan et al.
4,810,168 A 3/1989 Nogami et al.
4,821,997 A 4/1989 Zdeblick
4,824,073 A 4/1989 Zdeblick
4,865,525 A 9/1989 Kern
4,875,623 A 10/1989 Garris
4,913,624 A 4/1990 Seki et al.
4,915,126 A 4/1990 Gyllinder
4,915,160 A 4/1990 Reynolds
4,943,032 A 7/1990 Zdeblick
4,950,134 A 8/1990 Bailey et al.
4,952,386 A 8/1990 Davison
4,966,646 A 10/1990 Zdeblick
4,969,598 A 11/1990 Garris
5,050,062 A 9/1991 Hass
5,061,156 A 10/1991 Kuehne
5,061,574 A 10/1991 Henager, Jr.
5,062,770 A 11/1991 Story
5,134,962 A 8/1992 Amada
5,135,031 A 8/1992 Burgess
5,167,837 A 12/1992 Snodgrass
5,170,361 A 12/1992 Reed
5,192,198 A 3/1993 Gebauer
5,230,445 A 7/1993 Rusnak
5,261,442 A 11/1993 Kingsford
5,262,068 A 11/1993 Bowers
5,316,181 A 5/1994 Burch
5,318,413 A 6/1994 Bertoncini
5,332,311 A 7/1994 Volk, Jr. et al.
5,344,195 A 9/1994 Parimore, Jr. et al.
5,350,200 A 9/1994 Peterson et al.
5,380,019 A 1/1995 Hillery
5,434,774 A 7/1995 Seberger
5,476,004 A 12/1995 Kingsford
5,490,765 A 2/1996 Bailey
5,511,797 A 4/1996 Nikirk
5,516,429 A 5/1996 Snodgrass
5,527,161 A 6/1996 Bailey
5,546,009 A 8/1996 Raphael
5,575,311 A 11/1996 Kingsford
5,580,103 A 12/1996 Hall
5,599,100 A 2/1997 Jackson et al.
5,599,394 A 2/1997 Yabe
5,645,301 A 7/1997 Kingsford
5,652,391 A 7/1997 Kingsford
5,653,251 A 8/1997 Handler
5,743,293 A 4/1998 Kelly
5,762,795 A 6/1998 Bailey
5,772,899 A 6/1998 Snodgrass
5,784,573 A 7/1998 Szczepanek et al.
5,785,508 A 7/1998 Bolt
5,793,754 A 8/1998 Houldsworth et al.
5,839,828 A 11/1998 Glanville
5,848,605 A 12/1998 Bailey
5,947,702 A 9/1999 Biederstadt
5,971,723 A 10/1999 Bolt
5,991,279 A 11/1999 Haugli et al.
6,033,302 A 3/2000 Ahmed et al.
6,105,829 A 8/2000 Snodgrass
6,190,565 B1 2/2001 Bailey
6,238,576 B1 5/2001 Yajima
6,250,502 B1 6/2001 Cote
6,251,293 B1 6/2001 Snodgrass
6,298,941 B1 10/2001 Spadafora
6,302,660 B1 10/2001 Kurita
6,318,971 B1 11/2001 Ota
6,325,032 B1 12/2001 Sekiya et al.
6,325,932 B1 12/2001 Gibson
6,330,517 B1 12/2001 Dobrowskli
6,348,124 B1 2/2002 Garbett
6,474,950 B1 11/2002 Waldo
6,478,547 B1 * 11/2002 Savard et al. ..... 417/53
6,506,030 B1 1/2003 Kottke
6,520,519 B2 2/2003 Howard
6,540,265 B2 4/2003 Turk
6,554,579 B2 4/2003 Martin
6,572,255 B2 6/2003 Husher
6,575,264 B2 6/2003 Spadafora
6,592,825 B2 6/2003 Pelc
6,635,183 B2 10/2003 Gibson
6,742,992 B2 6/2004 Davis
6,742,993 B2 6/2004 Savard
6,766,810 B1 7/2004 Van Cleemput
6,767,877 B2 7/2004 Kuo
6,837,484 B2 1/2005 Kingsford
6,901,791 B1 6/2005 Frenz et al.
6,923,568 B2 8/2005 Wilmer et al.
6,925,072 B1 8/2005 Grohn
6,952,618 B2 10/2005 Davlin et al.
7,013,223 B1 3/2006 Zhang et al.
7,029,238 B1 4/2006 Zagars
7,063,785 B2 6/2006 Hlraku et al.
7,083,202 B2 8/2006 Eberle et al.
7,156,115 B2 1/2007 Everett et al.
7,247,245 B1 7/2007 Proulx et al.
7,249,628 B2 7/2007 Pillion et al.
7,272,452 B2 9/2007 Coogan et al.
7,383,967 B2 6/2008 Gibson
7,454,317 B2 11/2008 Karasawa
7,476,087 B2 1/2009 Zagars et al.
7,494,265 B2 2/2009 Niermeyer et al.
7,547,049 B2 6/2009 Gashgaee
7,660,648 B2 2/2010 Dykstra
7,684,446 B2 3/2010 McLoughlin
2002/0044536 A1 4/2002 Izumi et al.
2002/0095240 A1 7/2002 Sickinger
2003/0033052 A1 2/2003 Hillen et al.
2003/0040881 A1 2/2003 Steger et al.
2003/0148759 A1 8/2003 Leliveld
2003/0222798 A1 12/2003 Floros
2004/0050771 A1 3/2004 Gibson
2004/0057334 A1 3/2004 Wilmer et al.
2004/0072450 A1 4/2004 Collins
2004/0133728 A1 7/2004 Ellerbrock et al.
2005/0061722 A1 3/2005 Takao et al.
2005/0113941 A1 5/2005 Ii et al.
2005/0126985 A1 6/2005 Campbell
2005/0173463 A1 8/2005 Wesner
2005/0182497 A1 8/2005 Nakano
2005/0184087 A1 8/2005 Zagars
2005/0197722 A1 9/2005 Varone et al.
2005/0232296 A1 10/2005 Schultze et al.
2005/0238497 A1 10/2005 Holst
2006/0015294 A1 1/2006 Yetter, Jr. et al.
2006/0070960 A1 4/2006 Gibson
2006/0083259 A1 4/2006 Metcalf et al.
2007/0104586 A1 5/2007 Cedrone
2007/0125797 A1 6/2007 Cedrone
2007/0126233 A1 6/2007 Gashgaee
2007/0127511 A1 6/2007 Cedrone
2007/0128046 A1 6/2007 Gonnella
2007/0128047 A1 6/2007 Gonnella
2007/0128048 A1 6/2007 Gonnella
2007/0128050 A1 6/2007 Cedrone
2007/0206436 A1 9/2007 Niermeyer et al.
2007/0217442 A1 9/2007 McLoughlin
2007/0251596 A1 11/2007 Scherzer et al.
2008/0089361 A1 4/2008 Metcalf et al.
2008/0131290 A1 6/2008 Magoon et al.
2009/0047143 A1 2/2009 Cedrone
2009/0116334 A1 5/2009 Niermeyer et al.
2009/0157229 A1 6/2009 Rulkens et al.

FOREIGN PATENT DOCUMENTS

CA 1271140 7/1990
CN 133783 A 1/2002
CN 1590761 A 3/2005
DE 299 09 100 U1 8/1999
EP 0 249 655 A 12/1987

| | | | |
|---|---|---|---|
| EP | 0 410 394 | A | 1/1991 |
| EP | 0261972 | B1 | 12/1992 |
| EP | 0863538 | A2 | 9/1998 |
| EP | 0867649 | A2 | 9/1998 |
| EP | 0892204 | A2 | 1/1999 |
| EP | 1133639 | B1 | 6/2004 |
| GB | 661 522 | A | 11/1951 |
| JP | 58203340 | A | 11/1983 |
| JP | 11 026430 | A | 1/1999 |
| JP | 2009-517601 | | 4/2009 |
| JP | 2009-517618 | | 4/2009 |
| JP | 2009-517778 | | 4/2009 |
| JP | 2009-517888 | | 4/2009 |
| JP | 2009-521636 | | 6/2009 |
| WO | 96/35876 | A | 11/1996 |
| WO | WO 99/37435 | | 7/1999 |
| WO | WO 9906514 | A1 | 12/1999 |
| WO | WO 00/31416 | A1 | 6/2000 |
| WO | WO 0140646 | A3 | 6/2001 |
| WO | WO 02/090771 | A2 | 11/2002 |
| WO | WO 03/087675 | | 10/2003 |
| WO | WO 2006057957 | A2 | 6/2006 |
| WO | WO 2007067359 | A2 | 6/2007 |

OTHER PUBLICATIONS

Chinese Patent Office Official Action, Chinese Patent Application No. 2005101088364 dated May 23, 2008.
Patent Cooperation Treaty, International Preliminary Report on Patentability and Written Opinion, Ch. I, issued in PCT/US2006/045176 dated Apr. 9, 2009, Entegris, Inc., 5 pages.
International Search Report and Written Opinion issued in PCT/US07/17017, dated Jul. 3, 2008, 9 pages.
Intellectual Property Office of Singapore, Written Opinion issued in Patent Application No. 200803948-9 dated Jul. 2, 2009, Entegris, Inc., 10 pages.
International Search Report and Written Opinion issued in PCT/US06/44981, dated Aug. 8, 2008, 10 pages.
Office Action issued in U.S. Appl. No. 11/365,395, dated Aug. 19, 2008, McLoughlin, 19 pages.
Chinese Patent Office Official Action, Chinese Patent Application No. 200410079193.0, Mar. 23, 2007.
International Search Report and Written Opinion, PCT/US2006/045127, May 23, 2007.
International Search Report and Written Opinion, PCT/US2006/044908, Jul. 16, 2007.
International Search Report and Written Opinion, PCT/US2006/045175, Jul. 25, 2007.
International Search Report and Written Opinion, PCT/US2006/044907, Aug. 8, 2007.
International Search Report and Written Opinion, PCT/US2006/045177, Aug. 9, 2007.
International Search Report, PCT/US99/28002, mailed Mar. 14, 2000, 5 pgs.
Written Opinion issued in PCT/US99/28002, mailed Oct. 25, 2000, 8 pgs.
International Preliminary Examination Report, PCT/US99/28002, mailed Feb. 21, 2001, 9 pgs.
International Search Report and Written Opinion, PCT/US06/44907, mailed Aug. 8, 2007, 9 pgs.
International Preliminary Report on Patentability, Ch. I, PCT/US2006/044906, mailed Jun. 5, 2008, 7 pgs.
International Preliminary Report on Patentability, Ch. I, PCT/US2006/044907, mailed Jun. 5, 2008, 7 pgs.
International Preliminary Report on Patentability, Ch. I, PCT/US2006/044980, mailed Jun. 12, 2008, 7 pgs.
International Preliminary Report on Patentability, Ch. I, PCT/US2006/044908, mailed Jun. 12, 2008, 8 pgs.
International Preliminary Report on Patentability, Ch. I, PCT/US2006/045175, mailed Jun. 12, 2008, 6 pgs.
International Preliminary Report on Patentability, Ch. I, PCT/US2006/045127, mailed Jun. 12, 2008, 8 pgs.
International Preliminary Report on Patentability, Ch. I, PCT/US2006/045177, mailed Jun. 12, 2008, 5 pgs.
International Preliminary Report on Patentability, Ch. II, PCT/US07/05377, mailed Oct. 14, 2008, 14 pgs.
European Search Report, European Application No. 06838223.3, dated Aug. 12, 2009, 8 pgs.
Japanese Laid Open Publication No. JP-2009-528631, published Aug. 6, 2009, with International Search Report, Japanese Patent Office, 38 pgs.
Office Action issued in U.S. Appl. No. 09/447,504, mailed Feb. 27, 2001, 4 pgs.
Office Action issued in U.S. Appl. No. 09/447,504, mailed Nov. 18, 2003, 4 pgs.
Office Action issued in U.S. Appl. No. 09/447,504, mailed Jul. 13, 2004, 5 pgs.
Japanese Laid Open Publication No. JP-2009-529847, published Aug. 20, 2009, with International Search Report, Japanese Patent Office, 21 pgs.
Intellectual Property Office of Singapore, Written Opinion issued in Patent Application No. 200703671-8, dated Jul. 20, 2009, 4 pgs.
Chinese Patent Office Official Action, Chinese Patent Application No. 200580039961.2, dated Aug. 21, 2009 with English translation, 33 pgs.
Office Action issued in U.S. Appl. No. 11/364,286 dated Nov. 14, 2008, Gonella, 11 pages.
Office Action issued in U.S. Appl. No. 11/602,513, dated Nov. 14, 2008, Gashgaee, 7 pages.
European Patent Office Official Action, European Patent Application No. 00982386.5, Sep. 4, 2007.
International Search Report and Written Opinion, PCT/US2006/044906, Sep. 5, 2007.
International Search Report and Written Opinion, PCT/US2005/042127, Sep. 26, 2007.
International Search Report and Written Opinion, PCT/US2006/044980, Oct. 4, 2007.
Notification of Transmittal of International Preliminary Report on Patentability for PCT/US07/17017. Eight pages, dated Jan. 13, 2009.
International Preliminary Report on Patentability, Chap. I, issued in PCT/US2006/044981, mailed Nov. 6, 2008, 7 pgs.
International Preliminary Report on Patentability, Chap. II, issued in PCT/US2006/044981, mailed Feb. 2, 2009, 9 pgs.
Office Action issued in U.S. Appl. No. 11/365,395, mailed Feb. 2, 2009, McLoughlin, 18 pgs.
Office Action issued in U.S. Appl. No. 11/292,559, mailed Dec. 24, 2008, Gonnella, 18 pgs.
International Search Report and Written Opinion, PCT/US2006/045176, Apr. 21, 2008.
Office Action issued in U.S. Appl. No. 11/602,513, dated May 22, 2008.
International Preliminary Report on Patentability, Chapter I, and Written Opinion issued in PCT/US2006/044985, mailed Jun. 23, 2008, 5 pages.
Office Action issued in U.S. Appl. No. 11/292,559, mailed Apr. 17, 2009, Gonnella, 20 pages.
Office Action issued in U.S. Appl. No. 11/273,091, mailed Feb. 17, 2006, Gibson, 8 pages.
Office Action issued in U.S. Appl. No. 11/273,091, mailed Jul. 3, 2006, Gibson, 8 pages.
Office Action issued in U.S. Appl. No. 11/273,091, mailed Oct. 13, 2006, Gibson, 8 pages.
Office Action issued in U.S. Appl. No. 11/273,091, mailed Feb. 23, 2007, Gibson, 6 pages.
Office Action issued in U.S. Appl. No. 11/273,091, mailed Oct. 15, 2007, Gibson, 8 pages.
Office Action issued in U.S. Appl. No. 11/386,427, mailed Nov. 13, 2007, Niermeyer, 11 pages.
Office Action issued in U.S. Appl. No. 11/364,286 mailed Jun. 1, 2009, Gonnella, 14 pgs.
Intellectual Property Office of Singapore, Written Opinion issued in Patent Application No. 200803948-9 dated Jan. 19, 2010, 10 pgs.
Office Action issued Chinese Patent Appl. No. 200680050665.7, dated Mar. 11, 2010 (with English translation) 6 pgs.

Office Action issued in U.S. Appl. No. 11/364,286 mailed Apr. 7, 2010, 23 pgs.
Office Action issued in U.S. Appl. No. 11/292,559 mailed Apr. 14, 2010, 20 pgs.
Office Action issued in U.S. Appl. No. 11/602,508 mailed Apr. 15, 2010, 20 pgs.
Intellectual Property Office of Singapore, Written Opinion issued in Patent Application No. 200806425-5 dated Oct. 14, 2009, 8 pgs.
Office Action issued in U.S. Appl. No. 11/292,559 mailed Nov. 3, 2009, 17 pgs.
Office Action issued in U.S. Appl. No. 11/364,286 mailed Nov. 9, 2009, 19 pgs.
Office Action issued in Chinese Patent Application No. CN 200680050801.2, mailed Mar. 26, 2010, 13 pgs. (with English translation).
Office Action issued in U.S. Appl. No. 12/350,688 mailed Apr. 26, 2010, 10 pgs.
Supplementary European Search Report and European Written Opinion in Application No. EP06838071.6, dated Apr. 28, 2010, 5 pgs.
Office Action issued in U.S. Appl. No. 11/602,485 mailed Jun. 9, 2010, 9 pgs.
Office Action issued in U.S. Appl. No. 11/602,472 mailed Jun. 18, 2010, 13 pgs.
Office Action issued in U.S. Appl. No. 11/602,465 mailed Jun. 18, 2010, 14 pgs.
Office Action issued in U.S. Appl. No. 11/602,464 mailed Jun. 21, 2010, 19 pgs.
Office Action issued in Chinese Patent Application No. CN 200680045074.0, mailed Jun. 7, 2010, 8 pgs. (with English translation).
Office Action issued in Chinese Patent Application No. CN 200680050814.X (with English translation), mailed Aug. 6, 2010, 10 pgs.
Two-page brochure describing a Chempure Pump—A Furon Product, 1996.
Fifteen-page publication regarding "Characterization of Low Viscosity Photoresist Coating," Murthy S. Krishna, John W. Lewellen, Gary E. Flores. Advances in Resist Technology and Processing XV (Proceedings of SPIE (The International Society of Optical Engineering), Feb. 23-25, 1998, Santa Clara, California. vol. 3333 (Part Two of Two Parts). Feb. 23-25, 1998.
U.S. Patent Office Official Action issued Dec. 13, 2007 in U.S. Appl. No. 11/051,576, Raymond A. Zagars, Dec. 13, 2007.
International Search Report and Written Opinion issued in PCT/US06/44985, 7 pages, dated Mar. 27, 2009-Apr. 23, 2009.
Notice of Allowance issued in U.S. Appl. No. 11/364,286 mailed Sep. 21, 2010, 11 pgs.
Office Action issued in Chinese Patent Application No. CN 200780046952.5, mailed Sep. 27, 2010, 8 pgs. (English Translation).
Office Action issued in U.S. Appl. No. 11/292,559, dated Aug. 28, 2008, Gonnella, 19 pages.
Office Action issued in U.S. Appl. No. 11/602,485 mailed Nov. 19, 2010, 9 pgs.
Notice of Allowance for U.S. Appl. No. 11/602,508, mailed Dec. 14, 2010, 10 pgs.
Official Action for Chinese Patent Application No. 200680051448.X, mailed Dec. 1, 2010, with English translation, 20 pgs.
Notice of Allowance for U.S. Appl. No. 11/602,465, mailed Jan. 12, 2011, 19 pgs.

* cited by examiner

ERROR VOLUME SYSTEM AND METHOD FOR A PUMP

RELATED APPLICATIONS

The present Application claims under 35 U.S.C. 119(e) benefit of and priority to U.S. Provisional Patent Application No. 60/742,304 filed Dec. 5, 2005 entitled "Error Volume System and Method" by Cedrone et al., which is hereby fully incorporated by reference herein.

TECHNICAL FIELD OF THE INVENTION

This invention relates generally to fluid pumps. Even more particularly, embodiments of the present invention relate to error correction in a pump.

BACKGROUND OF THE INVENTION

There are many applications for which precise control over the amount and/or rate at which a fluid is dispensed by a pumping apparatus is necessary. In semiconductor processing, for example, it is important to control the amount and rate at which photochemicals, such as photoresist chemicals, are applied to a semiconductor wafer. The coatings applied to semiconductor wafers during processing typically require a flatness across the surface of the wafer that is measured in angstroms. The rates at which processing chemicals are applied to the wafer has to be controlled in order to ensure that the processing liquid is applied uniformly.

Pumps and the related system components for dispensing a fluid to a wafer generally have some amount of compliance. That is, they tend to expand in size based on the amount of pressure asserted on them. Consequently, some amount of work produced by the pump goes to the system compliance rather than moving fluid. If the pump and system compliance is not accounted for, the pump can dispense less fluid than intended or can produce a dispense with poor fluid characteristics. Therefore, there is a need for a system and method to account for the overall compliance of a dispense system.

SUMMARY OF THE INVENTION

Embodiments of the present invention provide systems and methods for reducing the error in the amount of a fluid a pump dispenses.

One embodiment of the present invention includes method for compensating for errors in dispense volumes of a dispense pump comprising determining a dispense volume amount from a dispense recipe, determining a value for a fluid property (e.g., viscosity or other property) based on the dispense recipe, determining an error volume amount based on the value of the fluid property from a correlation between the error volume and the fluid property that accounts for compliance in a dispense system and controlling a dispense motor to move a piston in the dispense pump to a position to account for the dispense volume amount determined from the recipe and the error volume amount to dispense the dispense volume amount of fluid from a nozzle. The method can also include compensating for other error volumes, such as user specified volumes. The pump can be controlled to move the piston to a position that accounts for the dispense volume and the error volumes in a time indicated by the recipe to dispense the dispense volume.

Another embodiment of the present invention includes a multi-stage pump comprising a pump body defining a dispense chamber, a diaphragm disposed in the dispense chamber, a piston reciprocating in the dispense chamber to move the diaphragm, a motor coupled to the piston to reciprocate the piston, and a controller coupled to the motor (i.e., able to directly or indirectly control the motor). The controller can include a memory storing a correlation between a fluid property and an error volume. Additionally, the controller can be operable to determine a dispense volume amount from a dispense recipe, determine a value for a fluid property based on the dispense recipe, access the memory to determine an error volume amount based on the value of the fluid property from the correlation and control the dispense motor to move the piston to a position associated by the controller with displacing at least the error volume amount and the dispense volume amount.

Another embodiment of the present invention comprises a method for compensating for system compliance in a dispense operation performed by a pump that includes portions performed with a test pump installed in a test dispense system and portions performed with a pump installed in a semiconductor manufacturing facility. The pump installed in the semiconductor manufacturing facility can be the same as or different than the test pump. With the test pump, the method can comprise performing a set of test dispenses with corresponding desired dispense volume amounts with a set of test fluids having various values for a fluid property and analyzing a set of actual dispense volume amounts of the test dispenses relative to the desired dispense volume amounts to determine a correlation between the fluid property and the error volume that accounts for compliance in a dispense system (i.e., the pump, tubing and associated components that exhibit compliance when fluid is dispensed from the pump to a site). With the pump installed in a semiconductor manufacturing facility, the method can include determining a desired manufacturing process dispense volume amount from a dispense recipe for dispensing a process fluid, determining a fluid property value for a process fluid based on the dispense recipe, determining an error volume amount based on the fluid property value for the process fluid from the correlation between the fluid property and the error volume and controlling a dispense motor to move a piston to a position to account for the desired manufacturing process dispense volume amount determined from the recipe and the error volume amount to dispense the dispense volume amount of fluid from a nozzle to a wafer.

Example steps that can be preformed at the test pump include a) performing test dispenses with a corresponding desired dispense volume amount with a selected test fluid from the set of test fluids, b) determining an average actual dispense volume amount, c) repeating steps a-b for each of a set of additional desired dispense volume amounts, d) repeating steps a-c selecting a new test fluid as the selected test fluid from the set of test fluids, wherein each test fluid has a different value for the fluid property and e) determining a relationship between error volume and the fluid property based on the average actual dispense volume amounts and the corresponding desired dispense volume amounts.

Embodiments of the present invention provide advantages over previous pumping systems by increasing the accuracy of a dispense operation.

Embodiments of the present invention provide another advantage over previous methods of compensating for error by compensating for compliance in an entire dispense system.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein.

DETAILED DESCRIPTION

Preferred embodiments of the present invention are illustrated in the FIGURES, like numerals being used to refer to like and corresponding parts of the various drawings.

Embodiments of the present invention are related to a pumping system that accurately dispenses fluid using a multiple stage ("multi-stage") pump. Embodiments of the present invention provide systems and methods for reducing the error in the amount of a fluid a pump dispenses by factoring in the compliance—that is the change in shape due to pressure—of a dispense system.

Generally speaking, in a diaphragm pump, the displacement of a piston in a chamber will displace a particular amount of fluid. In a rigid system, the amount of fluid displaced for a particular piston displacement would not vary regardless of pressure. However, most systems have some amount of compliance (e.g., stretching of parts due to pressure) leading to the problem that the same amount of piston displacement will dispense different amounts of liquid depending on the pressure. The difference between the desired dispense volume and the amount of fluid that a pump actually dispenses is referred to as an error volume. Embodiments of the present invention provide systems and methods to reduce the error volume by providing a mechanism through which the error volume is predicted and taken into account when moving the piston.

Figure 1:
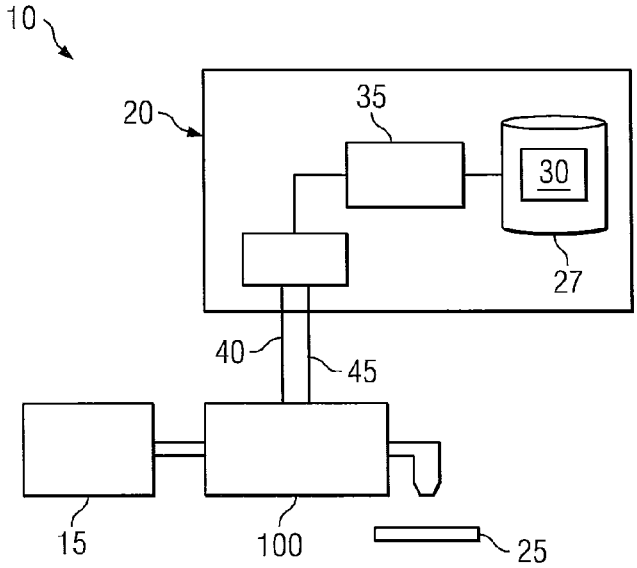
FIG. 1 is a diagrammatic representation of one embodiment of a pumping system.

For context, FIGS. 1-6 provide examples of dispenses systems and a multi-stage dispense pump for which error volume compensation can be implemented. Additional embodiments of multi-stage pumps are described in U.S. Provisional Patent Application No. 60/742,435, entitled "SYSTEM AND METHOD FOR MULTI-STAGE PUMP WITH REDUCED FORM FACTOR", by Inventors Cedrone et al., filed Dec. 5, 2005 and U.S. patent application Ser. No. 11/602,464, entitled "SYSTEM AND METHOD FOR A PUMP WITH REDUCED FORM FACTOR", by Inventors Cedrone et al., filed Nov. 20, 2006. It should, however, be understood that embodiments of the present invention can be implemented in other systems and pumps. FIG. 1 is a diagrammatic representation of a pumping system 10. The pumping system 10 can include a fluid source 15, a pump controller 20 and a multi-stage pump 100, which work together to dispense fluid onto a wafer 25. The operation of multi-stage pump 100 can be controlled by pump controller 20, which can be onboard multi-stage pump 100 or connected to multi-stage pump 100 via a one or more communications links for communicating control signals, data or other information. Additionally, the functionality of pump controller 20 can be distributed between an onboard controller and another controller. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC, DSP or other processor) can execute the instructions. One example of a processor is the Texas Instruments TMS320F2812PGFA 16-bit DSP (Texas Instruments is Dallas, Tex. based company). In the embodiment of FIG. 1, controller 20 communicates with multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Controller 20 can be implemented as an onboard PCB board, remote controller or in other suitable manner. Pump controller 20 can include appropriate interfaces (e.g., network interfaces, I/O interfaces, analog to digital converters and other components) to controller to communicate with multi-stage pump 100. Additionally, pump controller 20 can include a variety of computer components known in the art including processors, memories, interfaces, display devices, peripherals or other computer components not shown for the sake of simplicity. Pump controller 20 can control various valves and motors in multi-stage pump to cause multi-stage pump to accurately dispense fluids, including low viscosity fluids (i.e., less than 100 centipoise) or other fluids. An I/O interface connector as described in U.S. Patent Application Ser. No. 60/741,657, entitled "I/O INTERFACE SYSTEM AND METHOD FOR A PUMP," by Cedrone et al., filed Dec. 2, 2005 and U.S. patent application Ser. No. 11/602,449, entitled "I/O SYSTEMS, METHODS AND DEVICES FOR INTERFACING A PUMP CONTROLLER", by Inventors Cedrone et al., filed Nov. 20, 2006, which are hereby fully incorporated by reference herein, can be used to connected pump controller 20 to a variety of interfaces and manufacturing tools.

Figure 2:
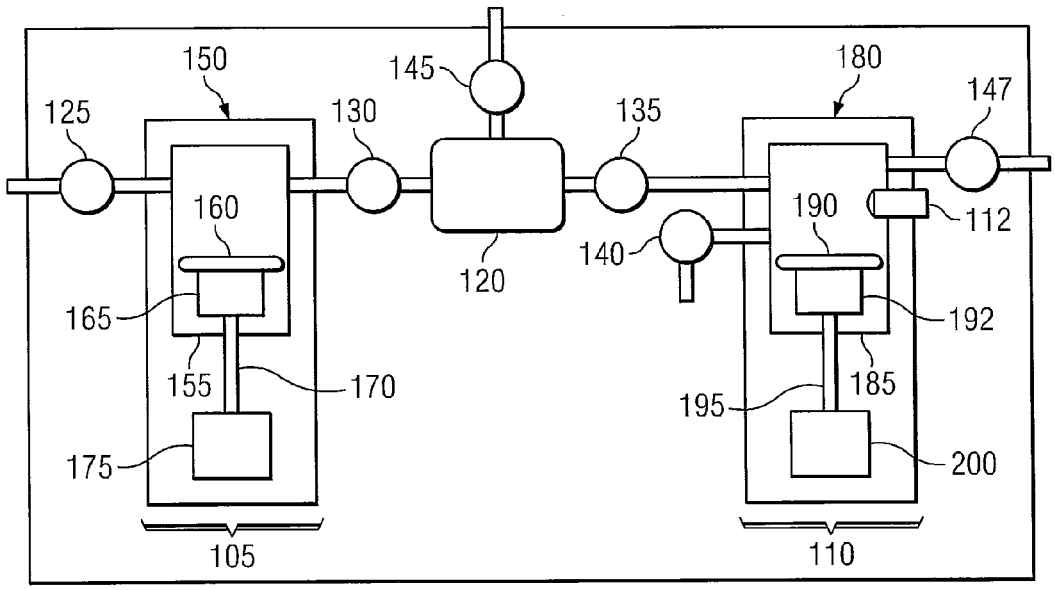
FIG. 2 is a diagrammatic representation of a multiple stage pump ("multi-stage pump") according to one embodiment of the present invention.

FIG. 2 is a diagrammatic representation of a multi-stage pump 100. Multi-stage pump 100 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can further include a pressure sensor 112 that determines the pressure of fluid at dispense stage 110. The pressure determined by pressure sensor 112 can be used to control the speed of the various pumps as described below. Example pressure sensors include ceramic and polymer pesioresistive and capacitive pressure sensors, including those manufactured by Metallux AG, of Korb, Germany. According to one embodiment, the face of pressure sensor 112 that contacts the process fluid is perfluoropolymer. Pump 100 can include additional pressure sensors, such as a pressure sensor to read pressure in feed chamber 155.

Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a stepper motor 175. Lead screw 170 couples to stepper motor 175 through a nut, gear or other mechanism for imparting energy from the motor to lead screw 170. According to one embodiment, feed motor 170 rotates a nut that, in turn, rotates lead screw 170, causing piston 165 to actuate. Dispense-stage pump 180 ("dispense pump 180") can similarly include a dispense chamber 185, a dispense stage diaphragm 190, a piston 192, a lead screw 195, and a dispense motor 200. Dispense motor 200 can drive lead screw 195 through a threaded nut (e.g., a Torlon or other material nut).

According to other embodiments, feed stage 105 and dispense stage 110 can be a variety of other pumps including pneumatically or hydraulically actuated pumps, hydraulic pumps or other pumps. One example of a multi-stage pump using a pneumatically actuated pump for the feed stage and a stepper motor driven hydraulic pump is described in U.S. patent application Ser. No. 11/051,576, entitled "PUMP CONTROLLER FOR PRECISION PUMPING APPARATUS", by Inventors Zagars et al., filed Feb. 4, 2005. The use of motors at both stages, however, provides an advantage in that the hydraulic piping, control systems and fluids are eliminated, thereby reducing space and potential leaks.

Feed motor 175 and dispense motor 200 can be any suitable motor. According to one embodiment, dispense motor 200 is a Permanent-Magnet Synchronous Motor ("PMSM"). The PMSM can be controlled by a digital signal processor ("DSP") utilizing Field-Oriented Control ("FOC") or other type of position/speed control known in the art at motor 200, a controller onboard multi-stage pump 100 or a separate pump controller (e.g. as shown in FIG. 1). PMSM 200 can further include an encoder (e.g., a fine line rotary position encoder) for real time feedback of dispense motor 200's position. The use of a position sensor gives accurate and repeatable control of the position of piston 192, which leads to accurate and repeatable control over fluid movements in dispense chamber 185. For, example, using a 2000 line encoder, which according to one embodiment gives 8000 pulses to the DSP it is possible to accurately measure to and control at 0.045 degrees of rotation. In addition, a PMSM can run at low velocities with little or no vibration. Feed motor 175 can also be a PMSM or a stepper motor. It should also be noted that the feed pump can include a home sensor to indicate when the feed pump is in its home position.

During operation of multi-stage pump 100, the valves of multi-stage pump 100 are opened or closed to allow or restrict fluid flow to various portions of multi-stage pump 100. According to one embodiment, these valves can be pneumatically actuated (i.e., gas driven) diaphragm valves that open or close depending on whether pressure or a vacuum is asserted. However, in other embodiments of the present invention, any suitable valve can be used.

The following provides a summary of various stages of operation of multi-stage pump 100. However, multi-stage pump 100 can be controlled according to a variety of control schemes including, but not limited to those described in U.S. Provisional Patent Application No. 60/742,168, entitled "SYSTEM AND METHOD FOR VALVE SEQUENCING IN A PUMP," by Gonnella et al., filed Dec. 2, 2005; U.S. patent application Ser. No. 11/602,465 entitled "SYSTEM AND METHOD FOR VALVE SEQUENCING IN A PUMP", by Inventors Gonnella, et al., filed Nov. 20, 2006; U.S. Provisional Patent Application No. 60/741,682, entitled "SYSTEM AND METHOD FOR PRESSURE COMPENSATION IN A PUMP" by Inventors Cedrone et al., filed Dec. 2, 2005; U.S. patent application Ser. No. 11/602,508 entitled "SYSTEM AND METHOD FOR PRESSURE COMPENSATION IN A PUMP" by Inventors Cedrone et al., filed Nov. 20, 2006; U.S. Provisional Patent Application No. 60/741,657, entitled "I/O Interface System and Method for a Pump," by Cedrone et al., filed Dec. 2, 2005; U.S. patent application Ser. No. 11/602,449, entitled "I/O SYSTEMS, METHODS AND DEVICES FOR INTERFACING A PUMP CONTROLLER", by Inventors Cedrone et al., filed Nov. 20, 2006, U.S. patent application Ser. No. 11/502,729 entitled "SYSTEMS AND METHODS FOR FLUID FLOW CONTROL IN AN IMMERSION LITHOGRAPHY SYSTEM" by Inventors Clarke et al., filed Aug. 11, 2006, Provisional Patent Application No. 60/741,681, entitled "SYSTEM AND METHOD FOR CORRECTING FOR PRESSURE VARIATIONS USING A MOTOR" by Gonnella et al., filed Dec. 2, 2005; U.S. patent application Ser. No. 11/602,472, entitled "SYSTEM AND METHOD FOR CORRECTING FOR PRESSURE VARIATIONS USING A MOTOR" by inventors Cedrone et al., filed Nov. 20, 2006; U.S. patent application Ser. No. 11/292,559 entitled "SYSTEM AND METHOD FOR CONTROL OF FLUID PRESSURE" by Inventors Gonnella et al., filed Dec. 2, 2005; U.S. patent application Ser. No. 11/364,286 entitled "SYSTEM AND METHOD FOR MONITORING OPERATION OF A PUMP" by Inventors Gonnella et al., filed Feb. 28, 2006, each of which is fully incorporated by reference herein, to sequence valves and control pressure. According to one embodiment, multi-stage pump 100 can include a ready segment, dispense segment, fill segment, pre-filtration segment, filtration segment, vent segment, purge segment and static purge segment. During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. According to other embodiments, both isolation valve 130 and barrier valve 135 can be opened and the feed pump moved to build pressure on the dispense side of the filter. During the filtration segment, dispense pump 180 can be brought to its home position. As described in U.S. Provisional Patent Application No. 60/630,384, entitled "System and Method for a Variable Home Position Dispense System" by Laverdiere, et al. filed Nov. 23, 2004 and PCT Application No. PCT/US2005/042127, entitled "System and Method for Variable Home Position Dispense System", by Applicant Entegris, Inc. and Inventors Laverdiere et al., filed Nov. 21, 2005, the home position of the dispense pump can be a position that gives the greatest available volume at the dispense pump for the dispense cycle, but is less than the maximum available volume that the dispense pump could provide. The home position is selected based on various parameters for the dispense cycle to reduce unused hold up volume of multi-stage pump 100. Feed pump 150 can similarly be brought to a home position that provides a volume that is less than its maximum available volume.

At the beginning of the vent segment, isolation valve 130 is opened, barrier valve 135 closed and vent valve 145 opened. In another embodiment, barrier valve 135 can remain open during the vent segment and close at the end of the vent segment. During this time, if barrier valve 135 is open, the pressure can be understood by the controller because the pressure in the dispense chamber, which can be measured by pressure sensor 112, will be affected by the pressure in filter 120. Feed-stage pump 150 applies pressure to the fluid to remove air bubbles from filter 120 through open vent valve 145. Feed-stage pump 150 can be controlled to cause venting to occur at a predefined rate, allowing for longer vent times and lower vent rates, thereby allowing for accurate control of the amount of vent waste. If feed pump is a pneumatic style pump, a fluid flow restriction can be placed in the vent fluid path, and the pneumatic pressure applied to feed pump can be increased or decreased in order to maintain a "venting" set point pressure, giving some control of an other wise uncontrolled method.

At the beginning of the purge segment, isolation valve 130 is closed, barrier valve 135, if it is open in the vent segment, is closed, vent valve 145 closed, and purge valve 140 opened and inlet valve 125 opened. Dispense pump 180 applies pressure to the fluid in dispense chamber 185 to vent air bubbles through purge valve 140. During the static purge segment, dispense pump 180 is stopped, but purge valve 140 remains open to continue to vent air. Any excess fluid removed during the purge or static purge segments can be routed out of multi-stage pump 100 (e.g., returned to the fluid source or discarded) or recycled to feed-stage pump 150. During the ready segment, inlet valve 125, isolation valve 130 and barrier valve 135 can be opened and purge valve 140 closed so that feed-stage pump 150 can reach ambient pressure of the source (e.g., the source bottle). According to other embodiments, all the valves can be closed at the ready segment.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening, followed by forward fluid motion caused by motor action. In other embodiments, outlet valve 147 can be opened and dispense begun by dispense pump 180 simultaneously.

An additional suckback segment can be performed in which excess fluid in the dispense nozzle is removed. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

Figure 3A:
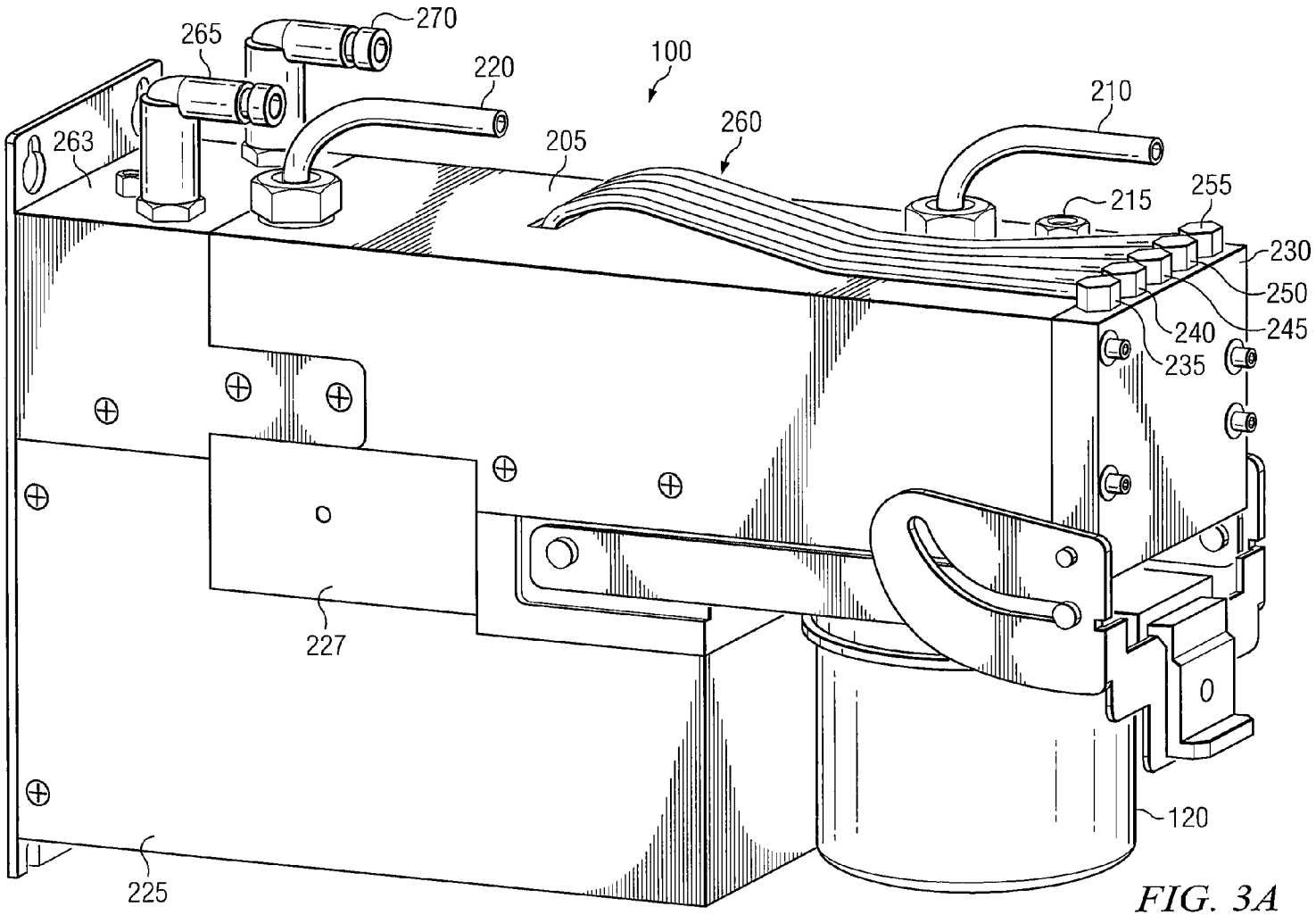
FIGS. 3A, 3B, 4A, 4C, and 4D are diagrammatic representations of various embodiments of a multi-stage pump.

FIG. 3A is a diagrammatic representation of one embodiment of a pump assembly for multi-stage pump 100. Multi-stage pump 100 can include a dispense block 205 that defines various fluid flow paths through multi-stage pump 100 and at least partially defines feed chamber 155 and dispense chamber 185. Dispense pump block 205, according to one embodiment, can be a unitary block of PTFE, modified PTFE or other material. Because these materials do not react with or is minimally reactive with many process fluids, the use of these materials allows flow passages and pump chambers to be machined directly into dispense block 205 with a minimum of additional hardware. Dispense block 205 consequently reduces the need for piping by providing an integrated fluid manifold.

Figure 4A:
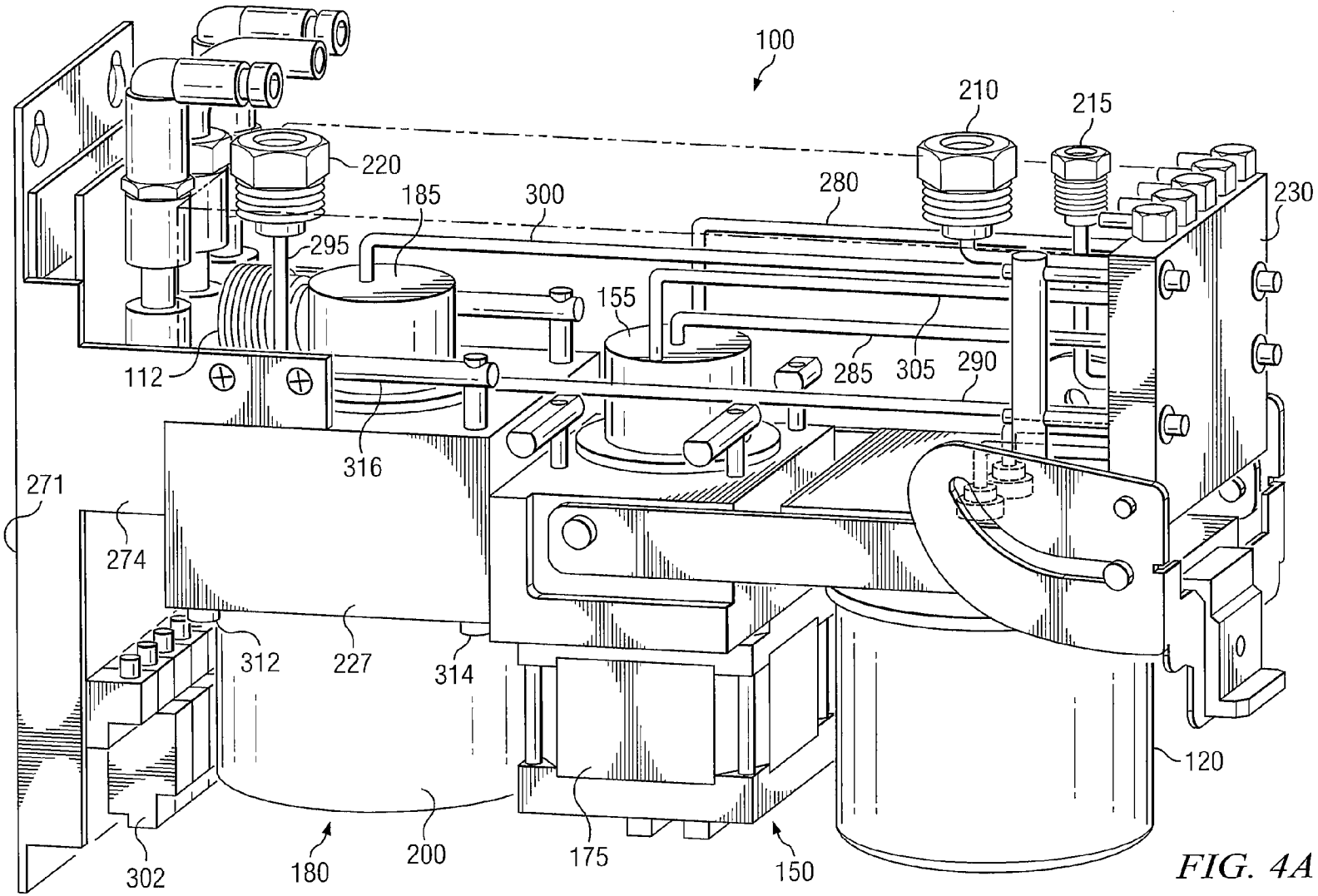
Figure 4B:
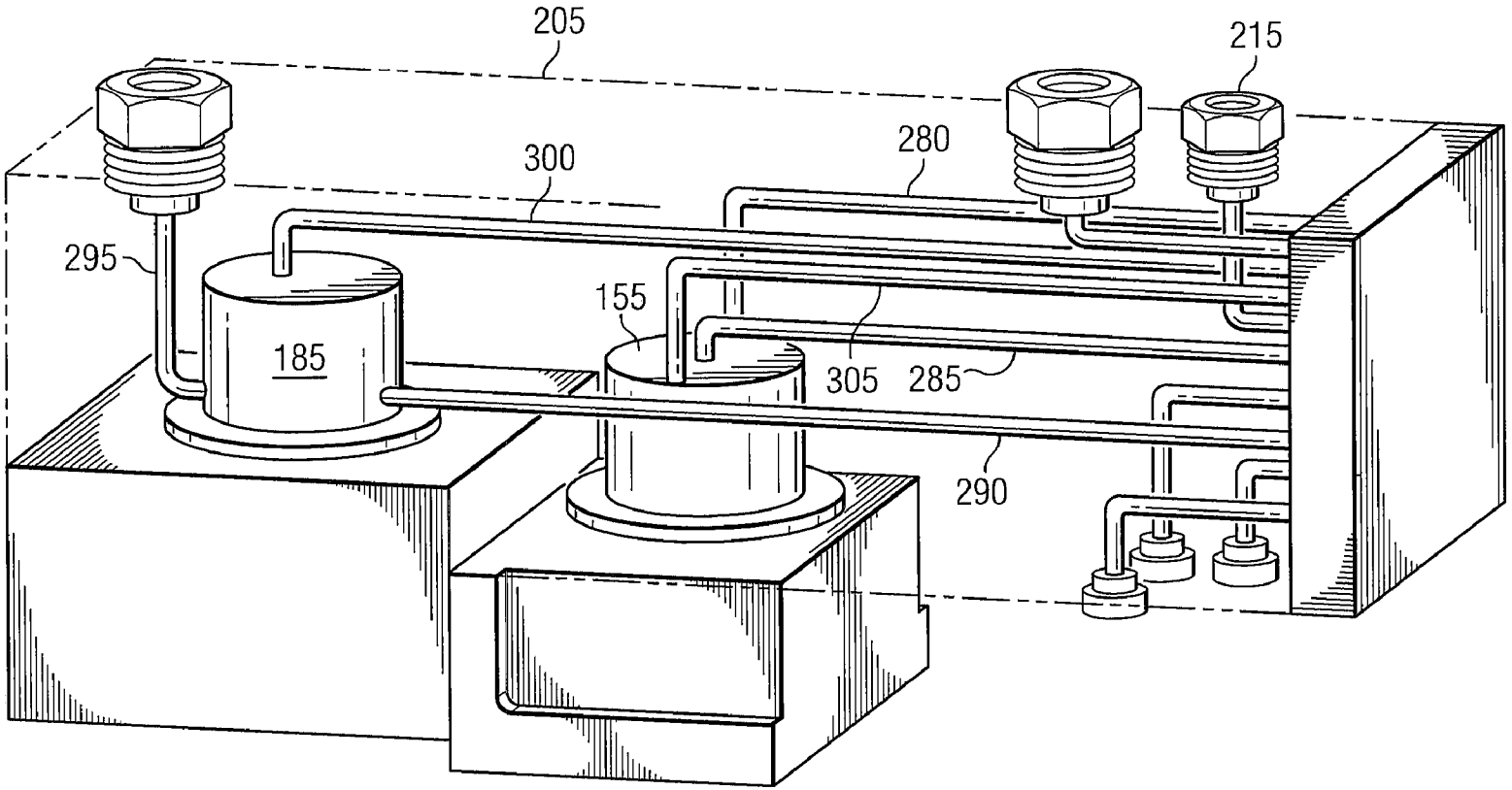
FIG. 4B is a diagrammatic representation of one embodiment of a dispense block.

Dispense block 205 can include various external inlets and outlets including, for example, inlet 210 through which the fluid is received, vent outlet 215 for venting fluid during the vent segment, and dispense outlet 220 through which fluid is dispensed during the dispense segment. Dispense block 205, in the example of FIG. 3A, does not include an external purge outlet as purged fluid is routed back to the feed chamber (as shown in FIG. 4A and FIG. 4B). In other embodiments of the present invention, however, fluid can be purged externally. U.S. Provisional Patent Application Ser. No. 60/741,667, entitled "O-Ring-Less Low Profile Fitting and Assembly Thereof" by Iraj Gashgaee, filed Dec. 2, 2005, and U.S. patent application Ser. No. 11/602,513, entitled "O-RING-LESS LOW PROFILE FITTINGS AND FITTING ASSEMBLIES", by Inventor Gashgaee, filed Nov. 20, 2006, which are hereby fully incorporated by reference herein, describe an embodiment of fitting that can be utilized to connect the external inlets and outlets of dispense block 205 to fluid lines.

Dispense block 205 routes fluid to the feed pump, dispense pump and filter 120. A pump cover 225 can protect feed motor 175 and dispense motor 200 from damage, while piston housing 227 can provide protection for piston 165 and piston 192 and, according to one embodiment of the present invention, be formed of polyethylene or other polymer. Valve plate 230 provides a valve housing for a system of valves (e.g., inlet valve 125, isolation valve 130, barrier valve 135, purge valve 140 and vent valve 145 of FIG. 2) that can be configured to direct fluid flow to various components of multi-stage pump 100. According to one embodiment, each of inlet valve 125, isolation valve 130, barrier valve 135, purge valve 140 and vent valve 145, is at least partially integrated into valve plate 230 and is a diaphragm valve that is either opened or closed depending on whether pressure or vacuum is applied to the corresponding diaphragm. In other embodiments, some of the valves may be external to dispense block 205 or arranged in additional valve plates. According to one embodiment, a sheet of PTFE is sandwiched between valve plate 230 and dispense block 205 to form the diaphragms of the various valves. Valve plate 230 includes a valve control inlet for each valve to apply pressure or vacuum to the corresponding diaphragm. For example, inlet 235 corresponds to barrier valve 135, inlet 240 to purge valve 140, inlet 245 to isolation valve 130, inlet 250 to vent valve 145, and inlet 255 to inlet valve 125 (outlet valve 147 is external in this case). By the selective application of pressure or vacuum to the inlets, the corresponding valves are opened and closed.

A valve control gas and vacuum are provided to valve plate 230 via valve control supply lines 260, which run from a valve control manifold (covered by pump cover 263 or housing cover 225), through dispense block 205 to valve plate 230. Valve control gas supply inlet 265 provides a pressurized gas to the valve control manifold and vacuum inlet 270 provides vacuum (or low pressure) to the valve control manifold. The valve control manifold acts as a three way valve to route pressurized gas or vacuum to the appropriate inlets of valve plate 230 via supply lines 260 to actuate the corresponding valve(s).

Figure 3B:
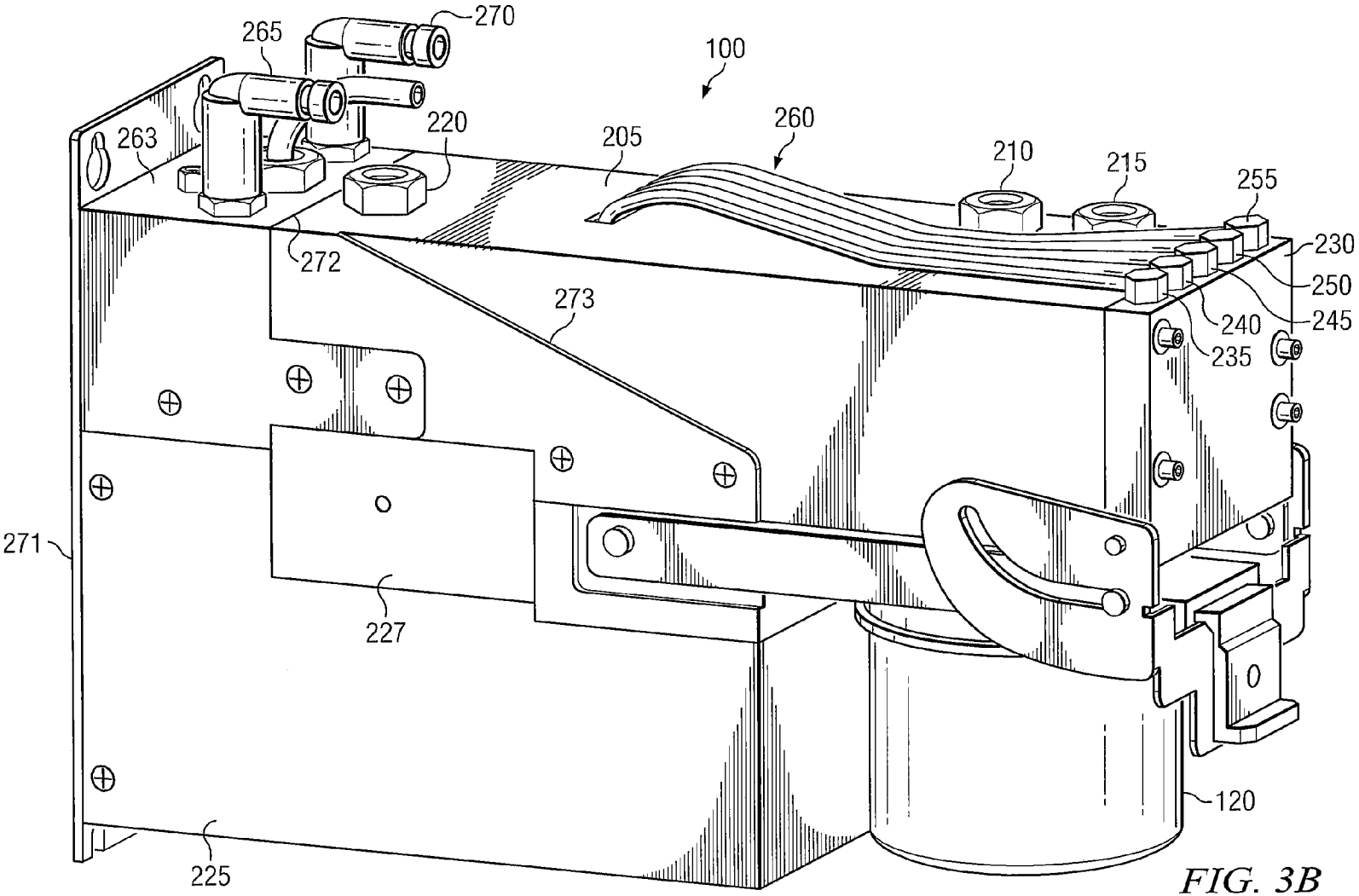

FIG. 3B is a diagrammatic representation of another embodiment of multistage pump 100. Many of the features shown in FIG. 3B are similar to those described in conjunction with FIG. 3A above. However, the embodiment of FIG. 3B includes several features to prevent fluid drips from entering the area of multi-stage pump 100 housing electronics. Fluid drips can occur, for example, when an operator connects or disconnects a tube from inlet 210, outlet 215 or vent 220. The "drip-proof" features are designed to prevent drips of potentially harmful chemicals from entering the pump, particularly the electronics chamber and do not necessarily require that the pump be "water-proof" (e.g., submersible in fluid without leakage). According to other embodiments, the pump can be fully sealed.

According to one embodiment, dispense block 205 can include a vertically protruding flange or lip 272 protruding outward from the edge of dispense block 205 that meets top cover 263. On the top edge, according to one embodiment, the top of top cover 263 is flush with the top surface of lip 272. This causes drips near the top interface of dispense block 205 and top cover 263 to tend to run onto dispense block 205, rather than through the interface. On the sides, however, top cover 263 is flush with the base of lip 272 or otherwise inwardly offset from the outer surface of lip 272. This causes drips to tend to flow down the corner created by top cover 263 and lip 272, rather than between top cover 263 and dispense block 205. Additionally, a rubber seal is placed between the top edge of top cover 263 and back plate 271 to prevent drips from leaking between top cover 263 and back plate 271.

Dispense block 205 can also include sloped feature 273 that includes a sloped surface defined in dispense block 205 that slopes down and away from the area of pump 100 housing electronics. Consequently, drips near the top of dispense block 205 are lead away from the electronics. Additionally, pump cover 225 can also be offset slightly inwards from the outer side edges of dispense block 205 so that drips down the side of pump 100 will tend to flow past the interface of pump cover 225 and other portions of pump 100.

According to one embodiment of the present invention, wherever a metal cover interfaces with dispense block 205, the vertical surfaces of the metal cover can be slightly inwardly offset (e.g., 1/64 of an inch or 0.396875 millimeters) from the corresponding vertical surface of dispense block 205. Additionally, multi-stage pump 100 can include seals, sloped features and other features to prevent drips from entering portions of multi-stage pump 100 housing electronics. Furthermore, as shown in FIG. 4A, discussed below, back plate 271 can include features to further "drip-proof" multi-stage pump 100.

FIG. 4A is a diagrammatic representation of one embodiment of multi-stage pump 100 with dispense block 205 made transparent to show the fluid flow passages defined there through. Dispense block 205 defines various chambers and fluid flow passages for multi-stage pump 100. According to one embodiment, feed chamber 155 and dispense chamber 185 can be machined directly into dispense block 205. Additionally, various flow passages can be machined into dispense block 205. Fluid flow passage 275 (shown in FIG. 4C) runs from inlet 210 to the inlet valve. Fluid flow passage 280 runs from the inlet valve to feed chamber 155, to complete the pump inlet path from inlet 210 to feed pump 150. Inlet valve 125 in valve housing 230 regulates flow between inlet 210 and feed pump 150. Flow passage 285 routes fluid from feed pump 150 to isolation valve 130 in valve plate 230. The output of isolation valve 130 is routed to filter 120 by another flow passage (not shown). These flow paths act as a feed stage outlet flow path to filter 120. Fluid flows from filter 120 through flow passages that connect filter 120 to the vent valve 145 and barrier valve 135. The output of vent valve 145 is routed to vent outlet 215 to complete a vent flow path while the output of barrier valve 135 is routed to dispense pump 180 via flow passage 290. Thus, the flow passage from filter 120 to barrier valve 135 and flow passage 290 act as feed stage inlet flow path. Dispense pump, during the dispense segment, can output fluid to outlet 220 via flow passage 295 (e.g., a pump outlet flow path) or, in the purge segment, to the purge valve through flow passage 300. During the purge segment, fluid can be returned to feed pump 150 through flow passage 305. Thus, flow passage 300 and flow passage 305 act as a purge flow path to return fluid to feed chamber 155. Because the fluid flow passages can be formed directly in the PTFE (or other material) block, dispense block 205 can act as the piping for the process fluid between various components of multi-stage pump 100, obviating or reducing the need for additional tubing. In other cases, tubing can be inserted into dispense block 205 to define the fluid flow passages. FIG. 4B provides a diagrammatic representation of dispense block 205 made transparent to show several of the flow passages therein, according to one embodiment.

Returning to FIG. 4A, FIG. 4A also shows multi-stage pump 100 with pump cover 225 and top cover 263 removed to show feed pump 150, including feed stage motor 190, dispense pump 180, including dispense motor 200, and valve control manifold 302. According to one embodiment of the present invention, portions of feed pump 150, dispense pump 180 and valve plate 230 can be coupled to dispense block 205 using bars (e.g., metal bars) inserted into corresponding cavities in dispense block 205. Each bar can include on or more threaded holes to receive a screw. As an example, dispense motor 200 and piston housing 227 can be mounted to dispense block 205 via one or more screws (e.g., screw 312 and screw 314) that run through screw holes in dispense block 205 to thread into corresponding holes in bar 316. It should be noted that this mechanism for coupling components to dispense block 205 is provided by way of example and any suitable attachment mechanism can be used.

Back plate 271, according to one embodiment of the present invention, can include inwardly extending tabs (e.g., bracket 274) to which top cover 263 and pump cover 225 mount. Because top cover 263 and pump cover 225 overlap bracket 274 (e.g., at the bottom and back edges of top cover 263 and the top and back edges pump cover 225) drips are prevented from flowing into the electronics area between any space between the bottom edge of top cover 263 and the top edge of pump cover 225 or at the back edges of top cover 263 and pump cover 225.

Manifold 302, according to one embodiment of the present invention can include a set of solenoid valves to selectively direct pressure/vacuum to valve plate 230. When a particular solenoid is on thereby directing vacuum or pressure to a valve, depending on implementation, the solenoid will generate heat. According to one embodiment, manifold 302 is mounted below a PCB board (which is mounted to back plate 271 and better shown in FIG. 4C) away from dispense block 205 and particularly dispense chamber 185. Manifold 302 can be mounted to a bracket that is, in turn, mounted to back plate 271 or can otherwise be coupled to back plate 271. This helps prevent heat from the solenoids in manifold 302 from affecting fluid in dispense block 205. Back plate 271 can be made of stainless steel, machined aluminum or other material that can dissipate heat from manifold 302 and the PCB. Put another way, back plate 271 can act as a heat dissipating bracket for manifold 302 and the PCB. Pump 100 can be further mounted to a surface or other structure to which heat can be conducted by back plate 271. Thus, back plate 271 and the structure to which it is attached act as a heat sink for manifold 302 and the electronics of pump 100.

Figure 4C:
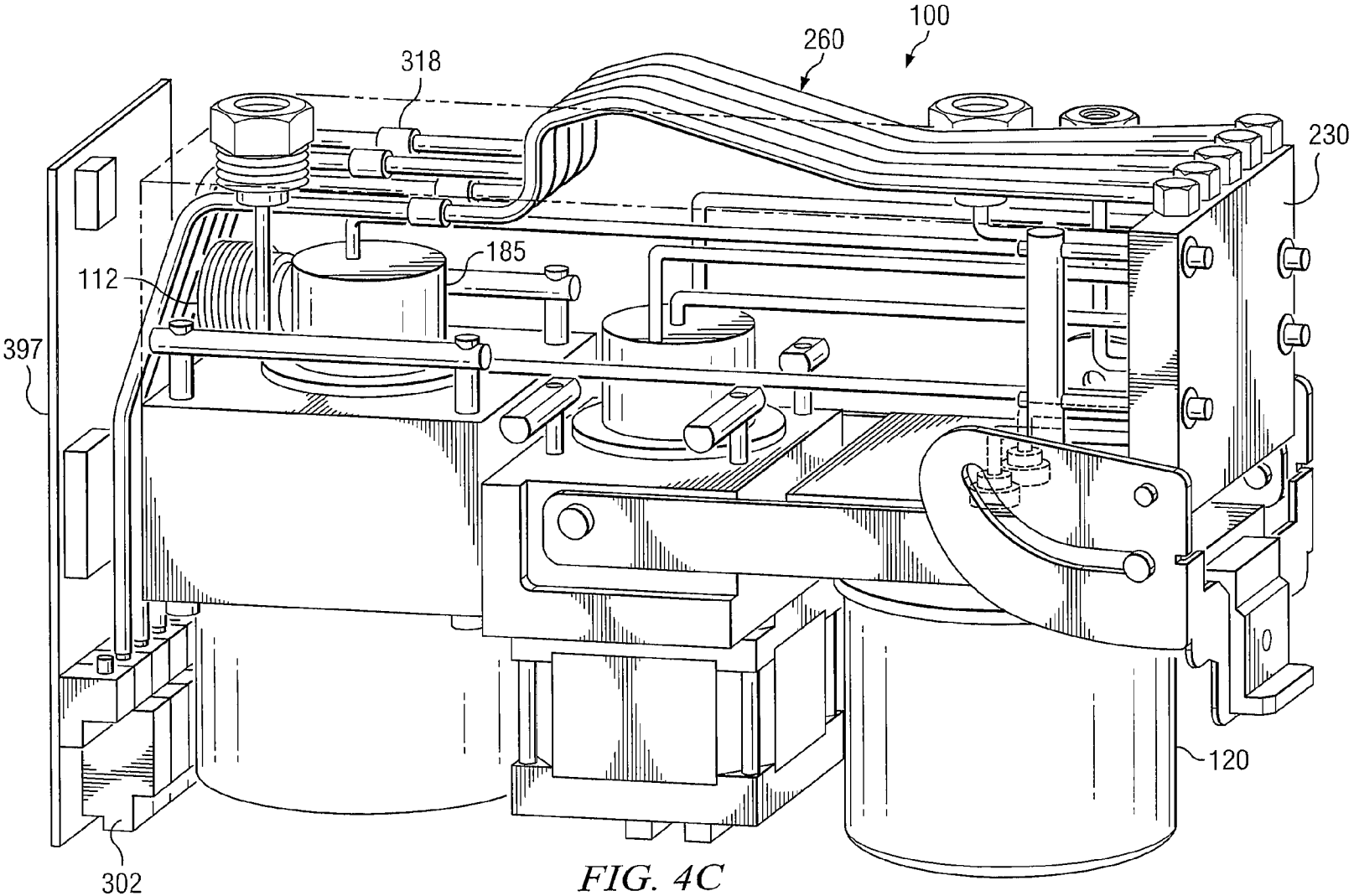

FIG. 4C is a diagrammatic representation of multi-stage pump 100 showing supply lines 260 for providing pressure or vacuum to valve plate 230. As discussed in conjunction with FIG. 3, the valves in valve plate 230 can be configured to allow fluid to flow to various components of multi-stage pump 100. Actuation of the valves is controlled by the valve control manifold 302 that directs either pressure or vacuum to each supply line 260. Each supply line 260 can include a fitting (an example fitting is indicated at 318) with a small orifice. This orifice may be of a smaller diameter than the diameter of the corresponding supply line 260 to which fitting 318 is attached. In one embodiment, the orifice may be approximately 0.010 inches in diameter. Thus, the orifice of fitting 318 may serve to place a restriction in supply line 260. The orifice in each supply line 260 helps mitigate the effects of sharp pressure differences between the application of pressure and vacuum to the supply line and thus may smooth transitions between the application of pressure and vacuum to the valve. In other words, the orifice helps reduce the impact of pressure changes on the diaphragm of the downstream valve. This allows the valve to open and close more smoothly which may lead to increased to smoother pressure transitions within the system which may be caused by the opening and closing of the valve and may in fact increase the longevity of the valve itself.

Figure 4D:
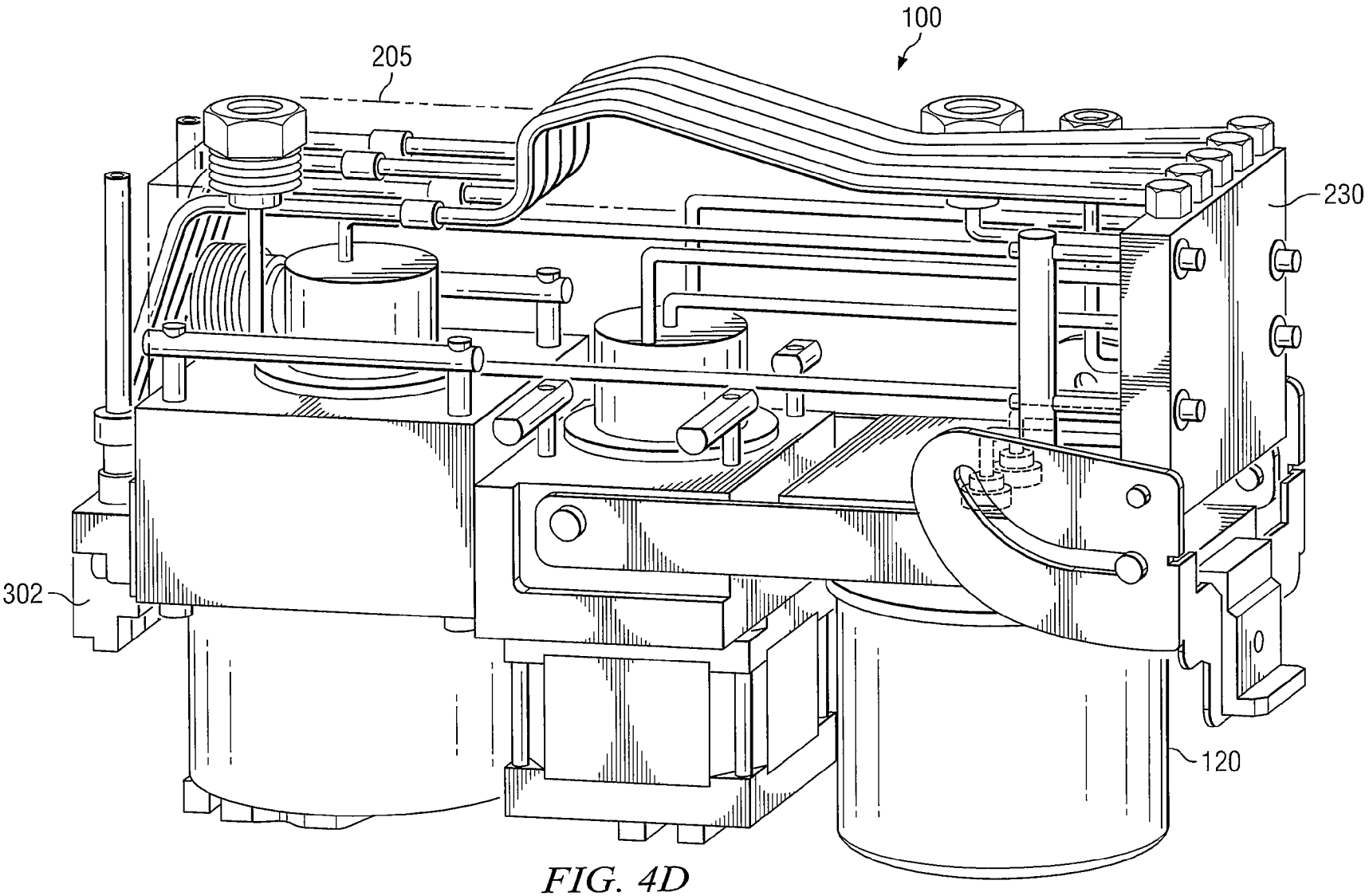

FIG. 4C also illustrates PCB 397. Manifold 302, according to one embodiment of the present invention, can receive signals from PCB board 397 to cause solenoids to open/close to direct vacuum/pressure to the various supply lines 260 to control the valves of multi-stage pump 100. Again, as shown in FIG. 4C, manifold 302 can be located at the distal end of PCB 397 from dispense block 205 to reduce the affects of heat on the fluid in dispense block 205. Additionally, to the extent feasible based on PCB design and space constraints, components that generate heat can be placed on the side of PCB away from dispense block 205, again reducing the affects of heat. Heat from manifold 302 and PCB 397 can be dissipated by back plate 271. FIG. 4D, on the other hand, is a diagrammatic representation of an embodiment of pump 100 in which manifold 302 is mounted directly to dispense block 205.

Figure 5A:
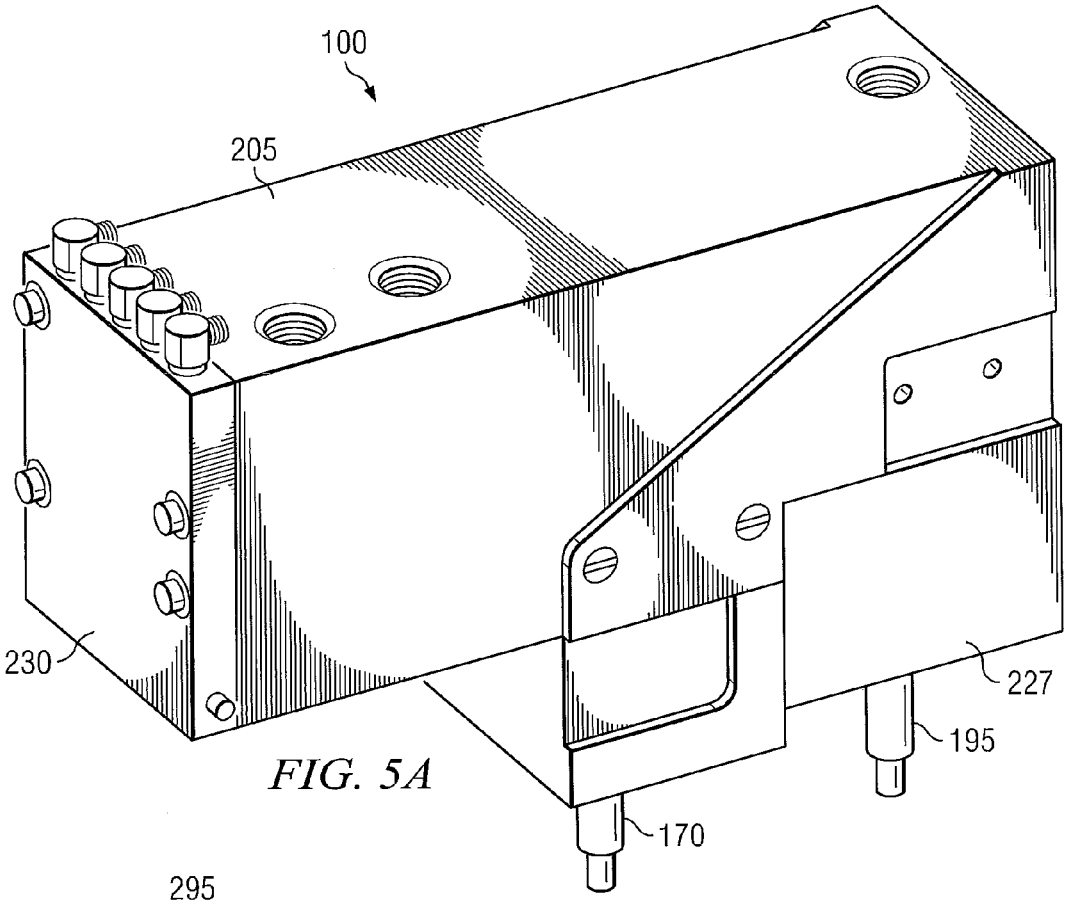
FIG. 5A is a diagrammatic representation of one embodiment of a portion of a multi-stage pump.
Figure 5B:
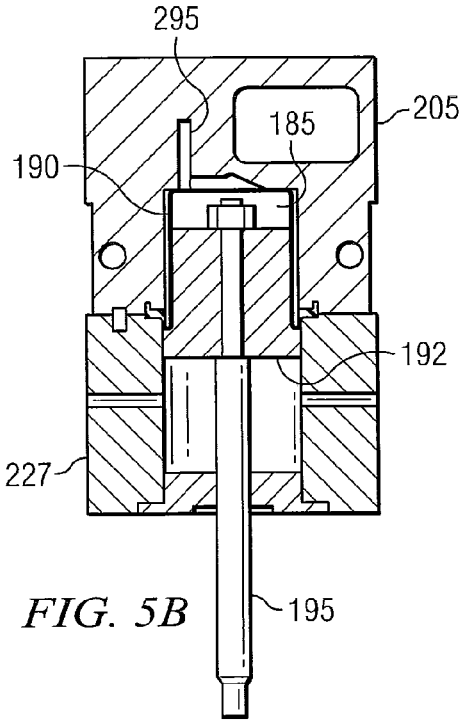
FIG. 5B is diagrammatic representation of a section of the embodiment of multi-stage pump of FIG. 5A including the dispense chamber.
Figure 5C:
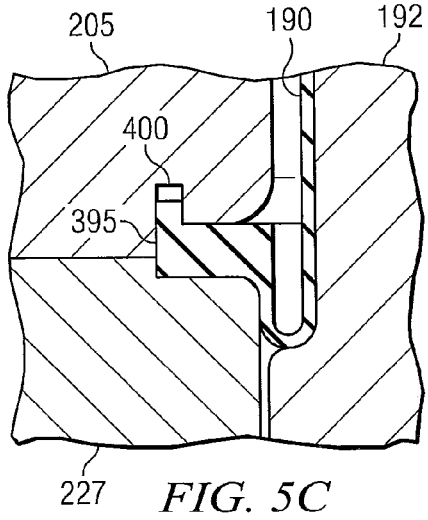
FIG. 5C is a diagrammatic representation of a section of the embodiment of multi-stage pump of FIG. 5B.

FIG. 5A illustrates a side view of a portion of multi-stage pump 100 including dispense block 205, valve plate 230, piston housing 227, lead screw 170 and lead screw 195. FIG. 5B illustrates a section view A-A of FIG. 5A showing dispense block 205, dispense chamber 185, piston housing 227, lead screw 195, piston 192 and dispense diaphragm 190. As shown in FIG. 5B, dispense chamber 185 can be at least partially defined by dispense block 205. As lead screw 195 rotates, piston 192 can move up (relative to the alignment shown in FIG. 5B) to displace dispense diaphragm 190, thereby causing fluid in dispense chamber 185 to exit the chamber via outlet flow passage 295 or purge flow passage 300. It should be noted that the entrances and exits of the flow passages can be variously placed in dispense chamber 185. FIG. 5C illustrates a section of FIG. 5B. In the embodiment shown in FIG. 5C, dispense diaphragm 190 includes a tong 395 that fits into a grove 400 in dispense block 200. The edge of dispense diaphragm 190, in this embodiment, is thus sealed between piston housing 227 and dispense block 205. According to one embodiment, dispense pump and/or feed pump 150 can be a rolling diaphragm pump.

It should be noted that the multi-stage pump 100 described in conjunction with FIGS. 1-5C is provided by way of example, but not limitation, and embodiments of the present invention can be implemented for other multi-stage pump configurations.

Figure 6:
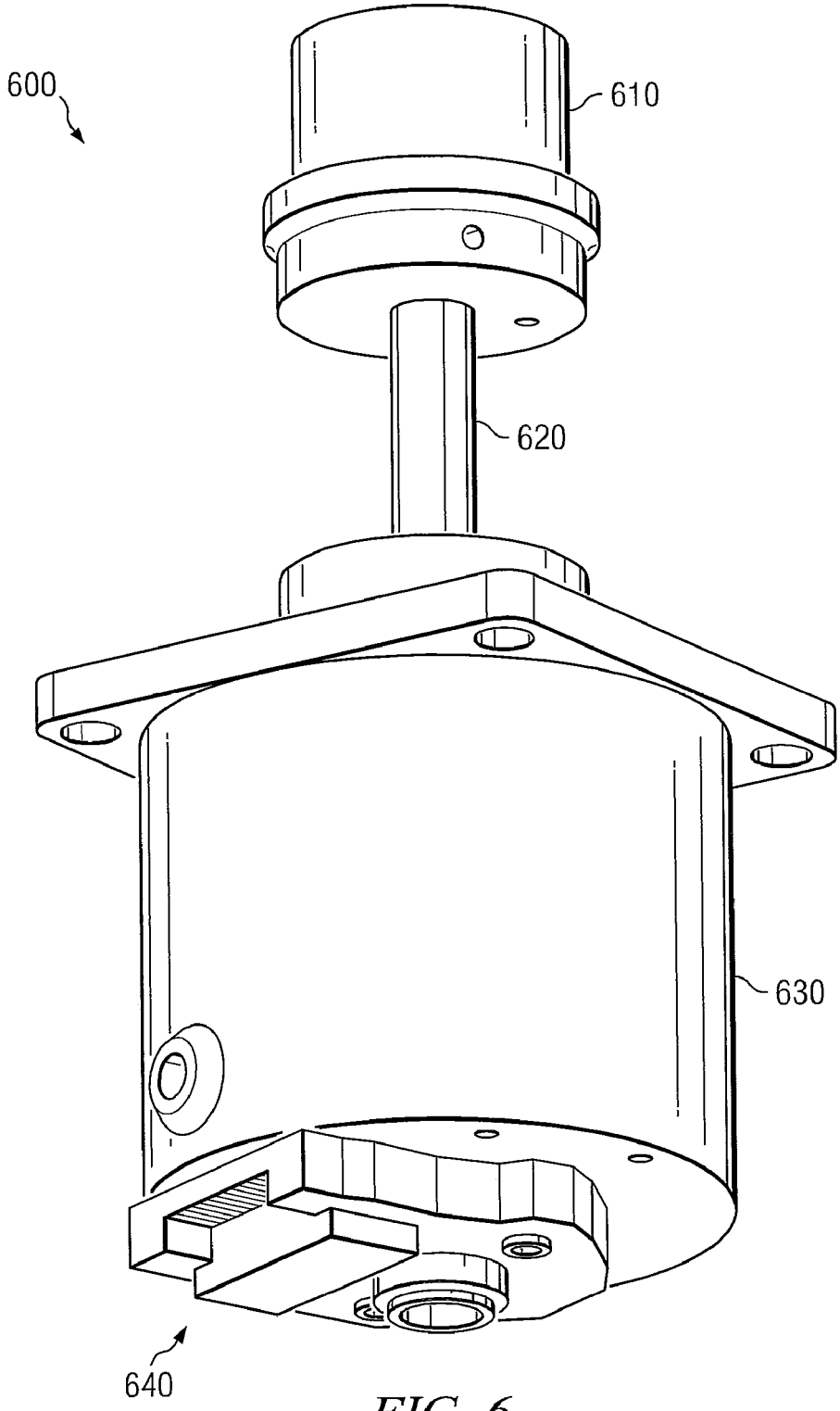
FIG. 6 is a diagrammatic representation of a motor assembly with a brushless DC motor, according to one embodiment of the invention.

As discussed above, feed pump 150 according to one embodiment of the present invention can be driven by a stepper motor while dispense pump 180 can be driven by a brushless DC motor or PSMS motor. FIG. 6 below describe an embodiment of a motor assembly usable according to various embodiments of the present invention.

FIG. 6 is a schematic representation of a particular embodiment of a motor assembly 600 with a motor 630 and a position sensor 640 coupled thereto, according to one embodiment of the invention. In the example shown in FIG. 6, a diaphragm assembly 610 is connected to motor 630 via a lead screw 620. In one embodiment, motor 630 is a permanent magnet synchronous motor ("PMSM"). Embodiments of a control schemes for a PMSM motor are described in U.S. Provisional Patent Application No. 60/741,660, entitled "SYSTEM AND METHOD FOR POSITION CONTROL OF A MECHANICAL PISTON IN A PUMP", by inventors Gonnella et al., filed Dec. 2, 2005, U.S. Provisional Patent Application No. 60/841,725, entitled "SYSTEM AND METHOD FOR POSITION CONTROL OF A MECHANICAL PISTON IN A PUMP", by inventors Gonnella et al., filed Sep. 1, 2006, and U.S. patent application Ser. No. 11/602,485, entitled "SYSTEM AND METHOD FOR POSITION CONTROL OF A MECHANICAL PISTON IN A PUMP", by Inventors Gonnella et al., filed Nov. 20, 2006, which are hereby fully incorporated by reference herein. In a brush DC motor, the current polarity is altered by the commutator and brushes. However, in a PMSM, the polarity reversal is performed by power transistors switching in synchronization with the rotor position. Hence, a PMSM can be characterized as "brushless" and is considered more reliable than brush DC motors. Additionally, a PMSM can achieve higher efficiency by generating the rotor magnetic flux with rotor magnets. Other advantages of a PMSM include reduced vibration, reduced noises (by the elimination of brushes), efficient heat dissipation, smaller foot prints and low rotor inertia. Depending upon how the stator is wounded, the back-electromagnetic force, which is induced in the stator by the motion of the rotor, can have different profiles. One profile may have a trapezoidal shape and another profile may have a sinusoidal shape. Within this disclosure, the term PMSM is intended to represent all types of brushless permanent magnet motors and is used interchangeably with the term brushless DC motors ("BLDCM").

PMSM 630 can be utilized as feed motor 175 and/or dispense motor 200 as described above. In one embodiment, pump 100 utilizes a stepper motor as feed motor 175 and PMSM 630 as dispense motor 200. Suitable motors and associated parts may be obtained from EAD Motors of Dover, N.H., USA or the like. In operation, the stator of BLDCM 630 generates a stator flux and the rotor generates a rotor flux. The interaction between the stator flux and the rotor flux defines the torque and hence the speed of BLDCM 630. In one embodiment, a digital signal processor (DSP) is used to implement all of the field-oriented control (FOC). The FOC algorithms are realized in computer-executable software instructions embodied in a computer-readable medium. Digital signal processors, alone with on-chip hardware peripherals, are now available with the computational power, speed, and programmability to control the BLDCM 630 and completely execute the FOC algorithms in microseconds with relatively insignificant add-on costs. One example of a DSP that can be utilized to implement embodiments of the invention disclosed herein is a 16-bit DSP available from Texas Instruments, Inc. based in Dallas, Tex., USA (part number TMS320F2812PGFA).

BLDCM 630 can incorporate at least one position sensor to sense the actual rotor position. In one embodiment, the position sensor may be external to BLDCM 630. In one embodiment, the position sensor may be internal to BLDCM 630. In one embodiment, BLDCM 630 may be sensorless. In the example shown in FIG. 6, position sensor 640 is coupled to BLDCM 630 for real time feedback of BLDCM 630's actual rotor position, which is used by the DSP to control BLDCM 630. An added benefit of having position sensor 640 is that it proves extremely accurate and repeatable control of the position of a mechanical piston (e.g., piston 192 of FIG. 2), which means extremely accurately and repeatable control over fluid movements and dispense amounts in a piston displacement dispense pump (e.g., dispense pump 180 of FIG. 2). In one embodiment, position sensor 640 is a fine line rotary position encoder. In one embodiment, position sensor 640 is a 2000 line encoder. Using a 2000 line encoder, it is possible to accurately measure to and control at 0.045 degrees of rotation.

BLDCM 630 can be run at very low speeds and still maintain a constant velocity, which means little or no vibration. In other technologies such as stepper motors it has been impossible to run at lower speeds without introducing vibration into the pumping system, which was caused by poor constant velocity control. This variation would cause poor dispense performance and results in a very narrow window range of operation. Although a particular motor assembly is shown, embodiments of the present invention can be implemented using a variety of motor assemblies for the feed and/or dispense motors.

Typically, dispense operations require dispensing fluid at a specified flow rate for a specified time so that a correct volume of fluid is dispensed during the time period. The flow rate of a fluid in a dispense system depends on the viscosity of the fluid and the pressure asserted on the fluid. In addition to dispensing a particular amount of fluid in a specified amount of time, it is desirable that the fluid dispenses as a fairly uniform column. An "good" dispense can be visualized as a straight column of fluid with perhaps some tapering at the ends as the outlet valve opens and closes, but without discontinuities, drips or significant deformations to the column.

Returning to FIGS. 2 and 3A, in a perfectly rigid system dispense piston 192 would always move the same amount to displace a particular volume of fluid with a good shape, regardless of the viscosity of the fluid. In actuality, however, dispense pump 100 and other components of the dispense system exhibit compliance. That is, the various components of the dispense system tend to stretch or expand under pressure, with the amount of compliance depending on the pressure. As dispense piston 192 moves, some of the movement goes into the compliance of the system. When dispense piston 192 stops moving, the components can contract, returning to their original volume. This can create problems with the quality of the column of dispensed fluid as the last part of the column is moved by the components returning to their unstrained (or less strained) states. As an example, assume a piston moves x distance, corresponding to a 1 mL dispense. Some of the volume of fluid will be dispensed, say 0.9 mL, while some of the volume of fluid, say 0.1 mL, takes up the additional volume caused by compliance. When the piston stops moving (and if the outlet valve is not closed), the additional 0.1 mL will dispense as the tubing, diaphragm and other components contract. While the proper 1 mL may be dispensed, the last 0.1 mL will typically not have a good shape as there may be discontinuities, drips or waves in the fluid column. Embodiments of the present invention can compensate for this by moving the piston further and closing the outlet valve when the proper amount of fluid has been dispensed to achieve a good dispense (e.g., a dispense with a substantially uniform fluid column).

An error volume can be determined for a dispense system including multi-stage pump 100 based on the viscosity of the process fluid (or other parameters). The error volume is a volume added to (or subtracted from) the dispense volume to compensate for the difference between a programmed dispense amount and the amount of fluid dispense pump 100 would dispense in the absence of factoring in an error volume (e.g., assuming that the outlet valve closes at the same time in either case). The error volume may be the result of the physical or control characteristics of pump 100, process variables or the system to which pump 100 is connected. The error volume can be translated into an additional amount the motor must move to provide the desired dispense amount. The pump controller can control the dispense motor to move the piston to a position that accounts for the dispense volume and the error volume. For example, if the dispense volume is 1 mL and the error volume is 0.1 mL, the pump controller can control the dispense motor to move the piston to a position that, according to the controller, corresponds to a 1.1 mL dispense. Due to compliance in the system, only 1 mL is actually dispensed in the time period.

Various methods can be used to determine the compliance of the pump and/or overall dispense system during a dispense operation. According to one embodiment, a length of tubing of known diameter and compliance is connected to outlet 210 and extended vertically. Dispense chamber 185 is filled with fluid so that a column of fluid fills a portion of the tubing and any air in chamber 185 is vented. The position of the top of the fluid column at atmospheric pressure is marked. Pressure can then be applied to the end of the tubing distal from the pump, thereby pressurizing the liquid column and the liquid in dispense chamber 185. This will cause the column of liquid to move down the tube. By measuring the difference between the position of the top of the column of fluid at the start and the position of the top of the column of fluid after the pressure is applied, the volumetric change based on pressure can be determined because the diameter of the tube is known (i.e., a drop of 1 millimeter will correspond to a particular number of cubic centimeters of fluid, based on the diameter of the tube). This volumetric change is caused by the compliance of the tube and the pump. The volumetric change due to the known compliance of the tube can be subtracted out to determine the compliance of just the pump.

The volumetric error caused by compliance of the pump can be added to a desired dispense volume to more accurately achieve the desired dispense volume. By way of example, if a pump has an error of 0.02 milliliters at a pressure of 5 psi above atmospheric and a dispense recipe requires a dispense of 1 milliliter of fluid at a particular flow rate that corresponds to a dispense pressure of 5 psi above atmospheric, the pump controller will move piston 192 an amount that, at atmospheric pressure (or in a perfectly rigid system) would cause the pump to dispense 1.02 milliliters of fluid. Put another way, the pump controller will cause dispense motor 200 to move extra distance to make up for the compliance of the pump at 5 psi.

A pump is rarely used in isolation, however, and methodologies that simply-account for the compliance of the pump do not adequately compensate for the compliance of the overall dispense system including the pump and additional components. Additionally, the above method does not account of the fact that a rolling diaphragm may have different compliances at the same pressure at different stages in movement. Furthermore, methods such as the one described above that rely on simply asserting a pressure on the fluid in a dispense chamber do not account for the fact that the valve timings and other control processes may reduce the pump compliance during dispense. Embodiments of the present invention provide a method to better determine the error volume caused by compliance in the overall system (including the pump) in a dispense operation to accurately dispense fluid in manufacturing facility. According to one embodiment, a pump can be calibrated in a test system designed to simulate the environment in which the pump will operated. The data generated from the calibration can be stored in a pump controller and used to determine the appropriate error volume for a given process recipe for dispensing a process fluid in a semiconductor manufacturing facility.

Figure 7:
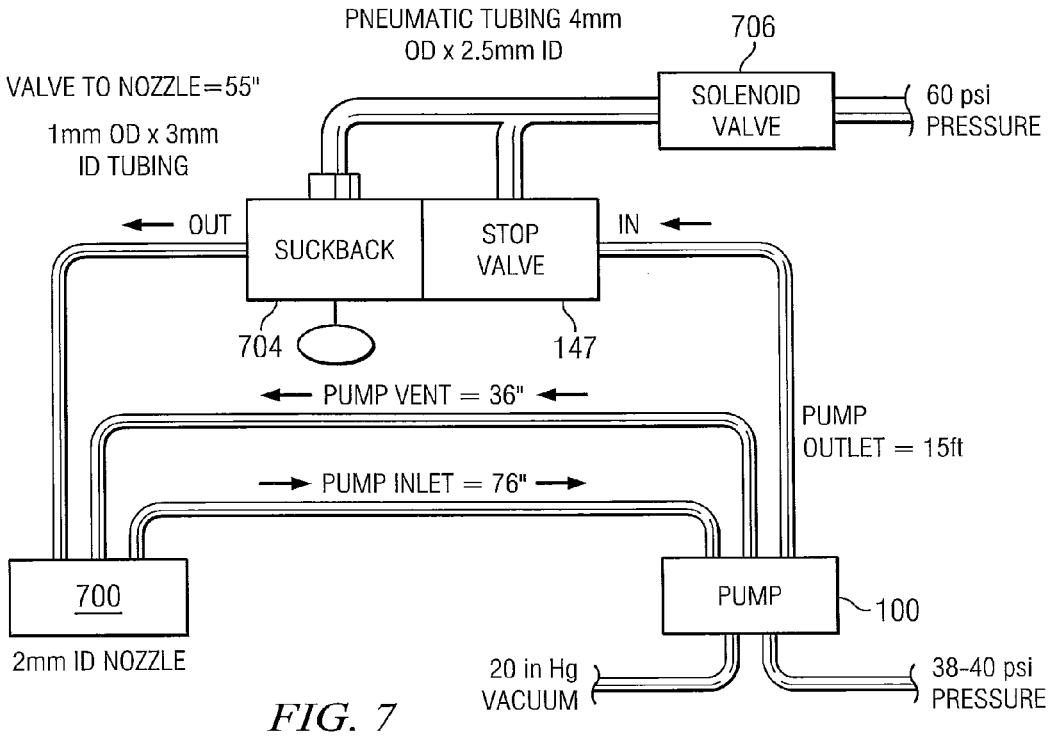
FIG. 7 is a diagrammatic representation of a system to determine a correlation between error volume and a fluid property for a dispense system.

FIG. 7 illustrates one embodiment of a setup for determining an error correction based on viscosity for a pump. It should be noted that the dimensions provided are provided by way of example and not limitation. Embodiments of the present invention can be implemented in a wide variety of test systems. The inlet and vent of multistage pump 100 are put in fluid communication with a fluid source 700 through tubing (in this example, 76 inches (193.04 centimeters) of tubing for the inlet and 36 inches (91.44 centimeters) of tubing for the vent, both ¼ inch OD×0.156 inch (0.396 centimeter) ID tubing). The outlet of multi-stage pump 100 is routed to an outlet valve 147 and suckback valve 704 through 15 feet of ¼ inch (0.635 centimeter) OD×0.157 inch (0.399 centimeter) ID tubing. From outlet valve 147 and suckback valve 704, pump 100 is in fluid communication with a calibrated balance (e.g., scale) (not shown) through 55 inches (139.7 centimeters) of 4 mm OD×0.3 mm ID tubing and a nozzle. At the end of the 55 inches (139.7 centimeters) of 4 mm OD tubing is a 2 mm ID nozzle.

A solenoid valve 706 (e.g., an SMC VQ11Y-5M solenoid valve from SMC Corporation of America of Indianapolis, Ind., USA) provides pressure to suckback valve 704 (e.g., needle valve part no. CKD AS1201FM of CKD USA Corp. of Rolling Meadows, Ill., USA and suckback valve CKDAMD-SZO-XO388) and outlet valve 147 through 15 inches of 4 mm OD×2.5 mm ID tubing. Solenoid valve 706 regulates 60 psi of pressure to outlet valve 147 and suckback valve 706 to open or close these valves. Additionally, 20 in Hg vacuum and 38-40 psi pressurized gas are provided to pump 100 to open close the various valves in valve plate 230 as described above.

According to one embodiment, pump 100 is primed with 4 cP viscosity standard, measure density of fluid and the dispense rate is set to 1.0 mL/sec. The dispense cycle is set to dispense 1 mL of fluid. The fluid is dispensed onto a calibrated balance (i.e., a scale) and the mass of 5 dispenses is recorded to find the average mass. The dispense volume is then changed 2 mL of fluid. Again, 5 dispenses are performed to a calibrated balance and the average mass is found. The process of finding the average mass dispensed for five dispenses is repeated for settings 4, 6, 8, and 10 mL dispense volumes. The process of finding the average mass of 5 dispenses for each set dispense volume (e.g., 1, 2, 4, 6, 8 and 10 mL) is repeated for 23, 45, 65 and 100 viscosity fluids. While specific examples of dispense amounts and viscosities are provided above, these are provided by of example and not limitation.

The viscosity based error volume (e.g., the difference between the average volume actually dispensed and the dispense volume setting) is plotted as a function of viscosity and a curve fit performed. This curve fit represents the error between a user defined dispense volume and the amount the pump would actually dispense. The curve (or a table representing the curve) can be saved in the firmware of pump 100. When a user sets up a dispense cycle, the user can enter the viscosity of the process fluid so that the pump can apply the appropriate error correction. Additional tables or curves can be developed if it is anticipated that dispenses will occur at different dispense rates. The calibration data generated using a particular pump can be installed in a set of pumps having common characteristics.

The embodiment of FIG. 7 illustrates one embodiment of a system that can be used for determining the correlation between viscosity (or other parameter) and error volume. Components of the test setup can be selected to approximate components in the anticipated manufacturing environment. For example, the outlet tubing from the pump 100 to outlet valve 147 (stop valve) can be 4-5 meters of 5-6.5 mm OD, 4-4.35 ID tubing. Outlet valve 147 can be a separate outlet valve or combination outlet valve, suckback valve such as a CKDAMDSZOX0388 by CKD USA Corp. of Rolling Meadows, Ill., USA. The tubing from outlet valve 147 (or the suckback valve) can be 4 mm OD, 2 mm ID tubing of approximately 1 to 1.5 meters long. Again, it should be noted that the various sizes and parts are provided by way of example and not limitation.

Figure 8:
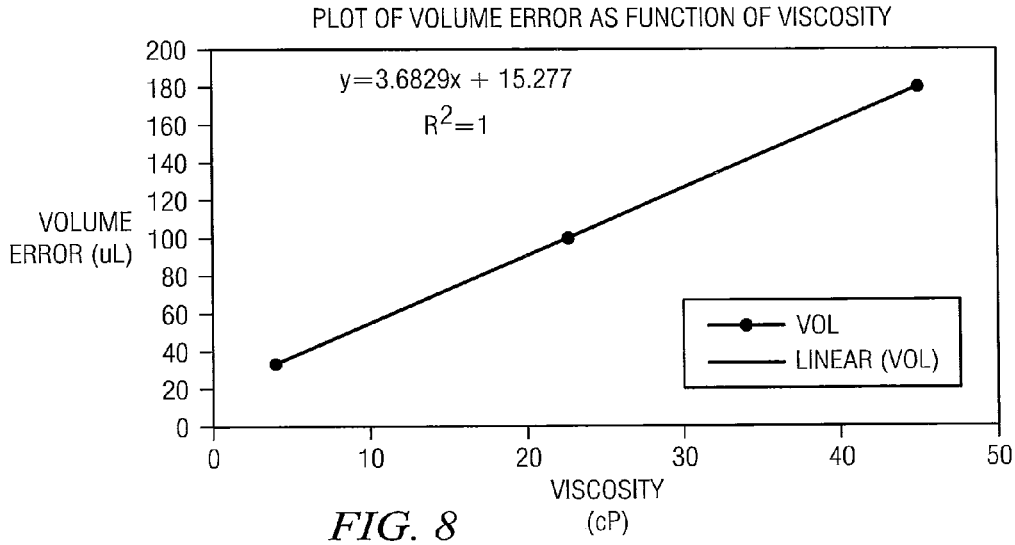
FIG. 8 is an example chart providing a correlation between error volume and viscosity.

FIG. 8 is a graph plotting volume error as a function of viscosity. It can be seen from this example graph that the error volume is approximately linear based on the viscosity of the process fluid. Thus, for example, if a user sets a dispense of 5 mL of 10 cP fluid, pump 100 can factor in the volume error of 0.052106 mL for 10 cP fluid. On the other hand, if the user sets a dispense of 5 mL of 20 cP fluid, pump 100 can factor in the volume error of 0.088935 mL.

It should be noted that other embodiments of the present invention can include different test setups (e.g., different lengths and diameters of tubing, different parts and different operating conditions). Additionally, testing can be performed using more or less dispense volumes and viscosities of fluids. Other schemes of determining the volume error can also be implemented.

When the pump is installed in the manufacturing facility, a user can enter a recipe (e.g., dispense amount, dispense time or flow rate, fluid viscosity or other parameters). Based on the fluid viscosity (or other fluid property), the pump controller can determine the appropriate error volume based on the correlation between the fluid property and error volume (e.g., through calculation, lookup table or other mechanism). Using the graph of FIG. 8, if the user enters a recipe for a fluid with a viscosity of 2 cP, a dispense volume of 2 mL and a flow rate of 1 mL/sec, the pump controller can automatically add 0.05211 mL to the 2 mL dispense. During dispense, the pump controller can cause dispense motor 200 to move piston 192 to a position to account for the dispense volume of 2 mL and the error volume of 0.05211 μL. Because of the compliance in the dispense system (including the pump 100), the amount dispensed will be approximately 2 mL.

The actual dispense system in which pump 100 is installed may differ from the test system in which the correlation between error volume and viscosity or other fluid property is developed. Therefore, even applying the error volume according to FIG. 8 may leave some small amount of error between the desired dispense and the actual dispense. According to one embodiment, the user can be given the option to specify a user specified error volume that is added to the dispense volume in addition to the error volume determined from the correlation (e.g., in addition to the viscosity based error volume). During dispense the pump controller can control dispense motor 200 to move piston 192 to a position, that according to the pump controller, accounts for the dispense volume, the viscosity based error volume and the user defined error volume.

If the pump is moved at the same velocity to a position that accounts for the dispense volume and the error volume(s) as it would move to just displace the dispense volume, the actual dispense rate will be below that specified in the recipe and the dispense time too long because the piston is traveling a longer distance at the same speed. To compensate for this, the pump controller can control dispense motor 200 to move to the appropriate position to account for the error volume(s) in the time prescribed by the recipe. Using the previous example, the pump controller can control dispense motor 200 to move piston 192 to a position to account for the 2 mL dispense volume, the 0.05211 mL viscosity error volume and the user specified error volume in 2 seconds based on the 2 cc dispense at 1 cc/sec specified in the original recipe. Consequently, the correct amount of fluid is dispensed in the correct amount of time. In any case, according to an embodiment, the outlet valve can be closed when piston 192 reaches the appropriate position so that additional fluid is not dispensed by contraction of system components.

Figure 9:
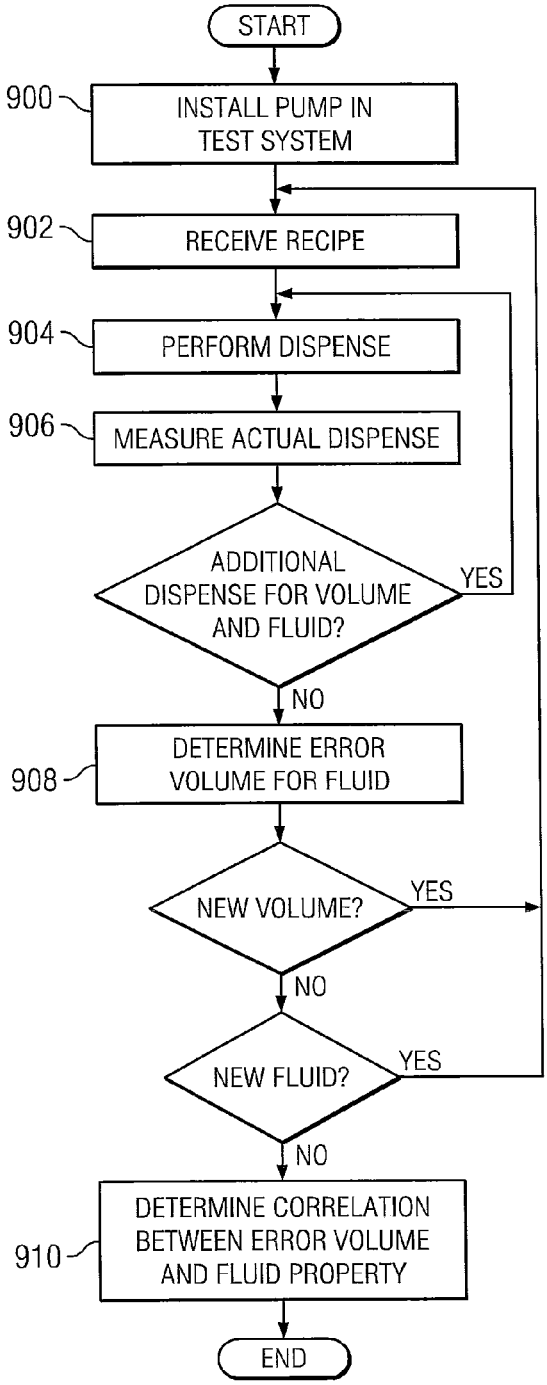
FIG. 9 is a flow chart illustrating one embodiment of determining the correlation between error volume and a fluid property.

FIG. 9 is a flow chart illustrating one embodiment of a method for determining an error volume for a pump. The steps of FIG. 9 can be performed in a test system designed to simulate expected manufacturing dispense systems. A test pump can be used to develop the correlation between a fluid property and error volume and the correlation propagated to multiple pumps, which may include the test pump, to be installed at a semiconductor manufacturing facility. At step 900 a pump is installed in a test dispense system that reasonably simulates an intended dispense environment. The controller of the test pump can initially be configured such that a particular position of the piston (e.g., based on actual position or displacement relative to a starting position) corresponds to a particular dispense volume. At step 902, a recipe including a dispense volume is programmed into the pump. The pump, at step 904, runs a dispense according to a recipe to dispense a volume of fluid. During the dispense, the pump controller can control the dispense motor to move the piston a distance corresponding to the dispense volume (i.e., the distance the controller is configured to associate with the dispense volume). At step 906, the dispensed fluid is measured to determine the volume of fluid actually dispensed. For example, when using a scale, the mass is determined and the mass divided by the density to determine the volume.

Steps 904 and 906 can be repeated any number of times with the same recipe and fluid. At step 908, the dispense volume and the results of measuring the actual dispense volumes can be analyzed to determine an error volume for the fluid. For example, the desired dispense volume specified in the recipe can be subtracted from the average dispense volume for a number of dispenses, say five dispenses, to determine the error volume under a particular set of conditions. Steps 902-906 can be repeated for a recipe having a new desired dispense volume and steps 902 through 908 can be repeated using a new fluid having a different value for the fluid property for which the correlation is being developed. At step 910, a correlation between error volume and viscosity (or other property of the fluid) determined. It should be noted that the correlation between error volume and fluid property can be done in terms of any measure corresponding to volume, such as an actual volume measure, a measure piston displacement distance, a mass, or other measure that corresponds to volume.

Figure 10:
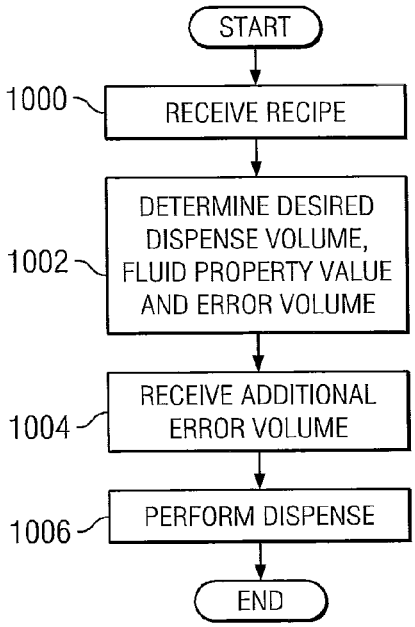
FIG. 10 is a flow chart illustrating one embodiment of a method for controlling a pump.

FIG. 10 illustrates one embodiment of a method for operating a pump to account for error volume. It is assumed, for purposes of FIG. 10, that the pump is installed in a semiconductor manufacturing facility and is programmed with the correlation(s) between error volume and fluid property as described above. At step 1000, a user can enter a recipe including, for example, a dispense volume (or information from which the dispense volume can be derived), a dispense time (or flow rate), and a fluid type (or viscosity). Based on the recipe, the pump controller, at step 1002, can determine a dispense volume amount, a value for the fluid property (e.g., viscosity) and, based on the correlation between error volume and fluid property, an error volume amount. This can be done, for example, through the use of a lookup table, calculations or other mechanism that utilizes the error volume correlations. It should be noted that in determining the dispense volume amount and error volume amounts can be any measure that corresponds to volume including a volume measure, a distance measure (e.g., the error volume amount can be a measure of how far to move the piston to displace a particular volume), or other measure that corresponds to volume.

If there are multiple correlation curves or sets of correlation data, the pump can select the correlation that best fits the recipe provided by the user. As another example, if the pump includes a correlation curve between viscosity and error volume for a 1 cc/sec dispense and for a 10 cc/sec dispense, the pump can select the correlation that more closely fits the recipe parameters. According to yet another embodiment, the pump controller can interpolate correlation data for recipe if the correlation data does not match a particular recipe. For example, if the pump controller has correlation data between viscosity and error volume for a 1 cc dispense and for a 10 cc dispense, but the recipe calls for a 7 cc/sec dispense, the pump controller can interpolate the relationship between viscosity and error volume for the 7 cc/sec dispense.

At step 1004, the pump controller can receive an additional error volume that can be user specified. A user, for example, can run a dispense that accounts for the error volume known to the pump controller (i.e., based on the correlations) and determine that the pump is still slightly under-dispensing fluid. This can occur if the actual dispense system or recipe varies significantly from the conditions under which the correlation data is developed. The user can provide the appropriate additional error volume to the pump controller.

At step 1006, the pump can perform a dispense. In the dispense, the pump controller can control the dispense motor to move to a position that, according to the controller, accounts for the dispense volume plus the error volume(s). In other words, the pump controller can convert the dispense volume plus the error volume(s) to a position or displacement (if not already measured as positions or displacements) and can control the dispense motor accordingly to move the piston to a particular position. However, because of compliance in the system, only the dispense volume is actually dispensed to the wafer. According to one embodiment, the controller can control dispense motor such that the dispense of fluid occurs in the time specified by the recipe. This can include controlling the dispense motor to move at a higher velocity to cover the greater distance required by the error volumes.

Various steps of FIGS. 9 and 10 can be implemented as computer instructions (e.g., computer instructions 30 of FIG. 1) stored on a computer readable medium (e.g., computer readable medium 27 of FIG. 1). The steps of FIGS. 9 and 10 can be repeated as needed or desired.

Figure 11:
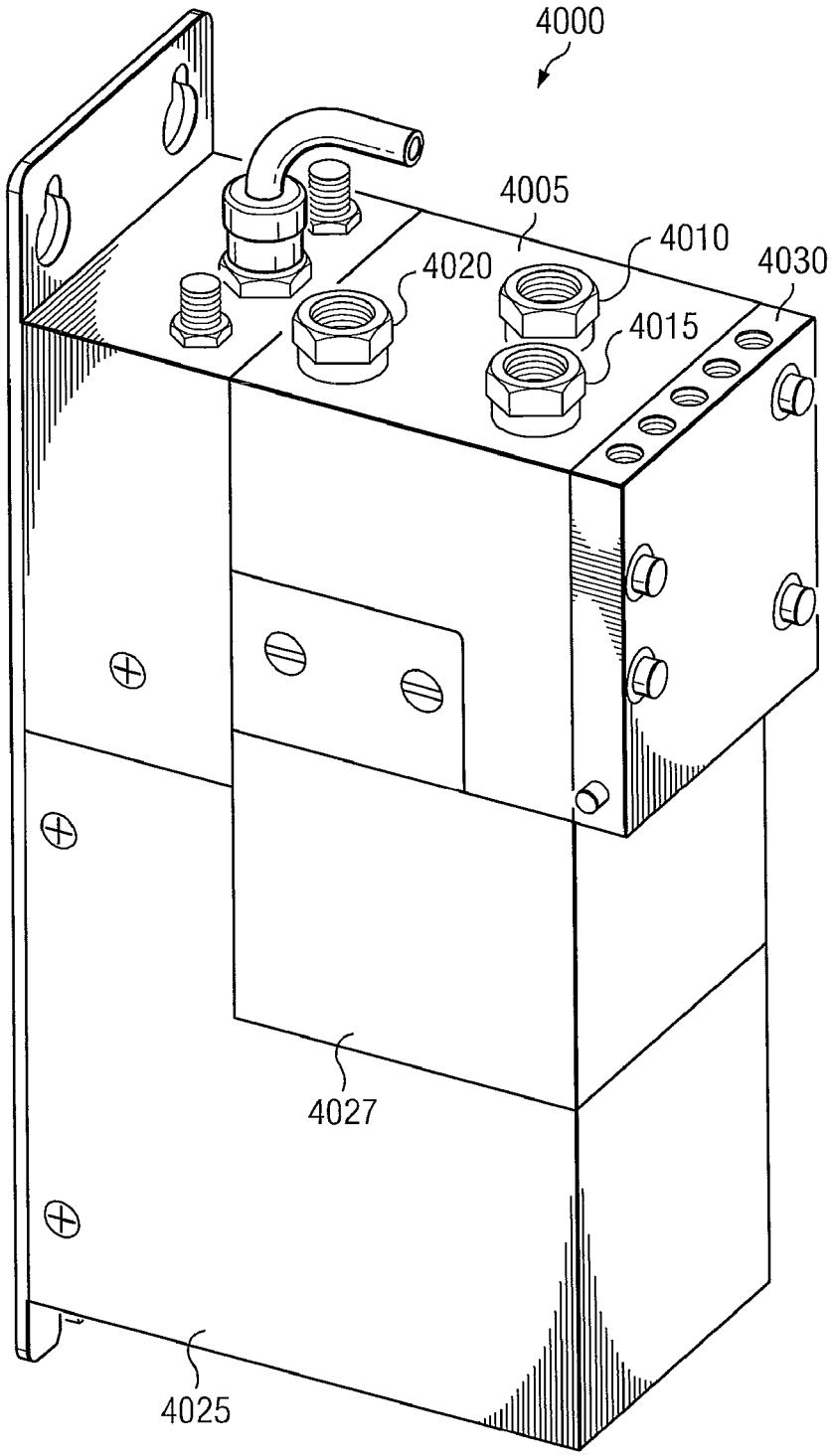
FIG. 11 is a diagrammatic representation of a single stage pump.

Although described in terms of a multi-stage pump, embodiments of the present invention can also be utilized in a single stage pump. FIG. 11 is a diagrammatic representation of one embodiment of a pump assembly for a pump 4000. Pump 4000 can be similar to one stage, say the dispense stage, of multi-stage pump 100 described above and can include a rolling diaphragm pump driven by a stepper, brushless DC or other motor. Pump 4000 can include a dispense block 4005 that defines various fluid flow paths through pump 4000 and at least partially defines a pump chamber. Dispense pump block 4005, according to one embodiment, can be a unitary block of PTFE, modified PTFE or other material. Because these materials do not react with or are minimally reactive with many process fluids, the use of these materials allows flow passages and the pump chamber to be machined directly into dispense block 4005 with a minimum of additional hardware. Dispense block 4005 consequently reduces the need for piping by providing an integrated fluid manifold.

Dispense block 4005 can include various external inlets and outlets including, for example, inlet 4010 through which the fluid is received, purge/vent outlet 4015 for purging/venting fluid, and dispense outlet 4020 through which fluid is dispensed during the dispense segment. Dispense block 4005, in the example of FIG. 23, includes the external purge outlet 4010 as the pump only has one chamber. U.S. Patent Application Ser. No. 60/741,667, entitled "O-RING-LESS LOW PROFILE FITTING AND ASSEMBLY THEREOF" by Iraj Gashgaee, filed Dec. 2, 2005, and U.S. patent application Ser. No. 11/602,513, entitled "O-RING-LESS LOW PROFILE FITTINGS AND FITTING ASSEMBLIES", by Inventor Iraj Gashgaee, filed Nov. 20, 2006, which are hereby fully incorporated by reference herein, describes an embodiment of fittings that can be utilized to connect the external inlets and outlets of dispense block 4005 to fluid lines.

Dispense block 4005 routes fluid from the inlet to an inlet valve (e.g., at least partially defined by valve plate 4030), from the inlet valve to the pump chamber, from the pump chamber to a vent/purge valve and from the pump chamber to outlet 4020. A pump cover 4225 can protect a pump motor from damage, while piston housing 4027 can provide protection for a piston and, according to one embodiment of the present invention, be formed of polyethylene or other polymer. Valve plate 4030 provides a valve housing for a system of valves (e.g., an inlet valve, and a purge/vent valve) that can be configured to direct fluid flow to various components of pump 4000. Valve plate 4030 and the corresponding valves can be formed similarly to the manner described in conjunction with valve plate 230, discussed above. According to one embodiment, each of the inlet valve and the purge/vent valve is at least partially integrated into valve plate 4030 and is a diaphragm valve that is either opened or closed depending on whether pressure or vacuum is applied to the corresponding diaphragm. In other embodiments, some of the valves may be external to dispense block 4005 or arranged in additional valve plates. According to one embodiment, a sheet of PTFE is sandwiched between valve plate 4030 and dispense block 4005 to form the diaphragms of the various valves. Valve plate 4030 includes a valve control inlet (not shown) for each valve to apply pressure or vacuum to the corresponding diaphragm.

As with multi-stage pump 100, pump 4000 can include several features to prevent fluid drips from entering the area of multi-stage pump 100 housing electronics. The "drip proof" features can include protruding lips, sloped features, seals between components, offsets at metal/polymer interfaces and other features described above to isolate electronics from drips. The electronics and manifold and PCB board can be configured similarly to the manner described above to reduce the effects of heat on fluid in the pump chamber.

Thus, embodiments of the present invention can include a method for compensating for errors in dispense volumes of a pump comprising determining a dispense volume amount from a dispense recipe, determining a value for a fluid property based on the dispense recipe, determining an error volume amount based on the value of the fluid property from a correlation between the error volume and the fluid property that accounts for compliance in a dispense system and controlling a dispense motor to move a piston in the dispense pump to a position to account for the dispense volume amount determined from the recipe and the error volume amount to dispense the dispense volume amount of fluid from a nozzle.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the scope of this invention as claimed.

What is claimed is:

1. A method for compensating for errors in dispense volumes of a dispense system comprising:

a pump controller determining a dispense volume amount based on a dispense recipe, wherein the pump controller is operable to control operation of a dispense pump, wherein the dispense system comprises the pump controller, the dispense pump, and one or more tubes downstream of the dispense pump;

the pump controller determining a value for a fluid property based on the dispense recipe;

the pump controller determining a correlation between the error volume of the dispense pump and the one or more tubes and the fluid property, wherein the correlation accounts for compliance in the dispense pump and the one or more tubes;

the pump controller determining an error volume amount based on the value of the fluid property and the correlation; and the pump controller controlling a dispense motor to move a piston in the dispense pump to a position to account for the dispense volume amount determined from the recipe and the error volume amount to dispense the dispense volume amount of fluid from a nozzle.

2. The method of claim 1, wherein the pump controller controlling the dispense motor further comprises the pump controller controlling the dispense motor to move the piston to the position in a time specified by the recipe to dispense the dispense volume amount.

3. The method of claim 1, further comprising:

the pump controller receiving a user specified error volume that accounts for a difference between a test dispense system and the dispense system.

4. The method of claim 3, wherein the position further accounts for the user specified error volume.

5. The method of claim 4, wherein the pump controller controlling the dispense motor further comprises the pump controller controlling the dispense motor to move the piston to the position in a time specified by the recipe to dispense the dispense volume amount.

6. The method of claim 1, further comprising:

a test pump controller developing the correlation between the error volume and the fluid property in a test dispense system that comprises at least the test pump controller, a test pump, and one or more test pump tubes, wherein the test dispense system is configured to simulate the dispense system.

7. The method of claim 6, wherein the test pump controller developing the correlation further comprises:

performing a set of test dispenses with corresponding desired dispense volume amounts with fluids having various values for the fluid property;

the test pump controller analyzing a set of actual dispense volume amounts of the test dispenses relative to the desired dispense volume amounts to determine the correlation between the fluid property and the error volume, wherein the correlation accounts for compliance in the test dispense system, wherein the compliance comprises compliance of the test dispense pump and compliance of the one or more test pump tubes.

8. The method of claim 6, wherein the test pump controller developing the correlation further comprises:

a) the test pump controller performing a set of test dispenses with a corresponding desired dispense volume amount with a test fluid;

b) the test pump controller determining an average actual dispense volume amount;

c) the test pump controller repeating steps a-b for each of a set of additional desired dispense volume amounts;

d) the test pump controller repeating steps a-c for each of a set of additional test fluids, wherein each test fluid has a different value for the fluid property;

e) the test pump controller determining the correlation between error volume and the fluid property based on the average actual dispense volume amounts and the corresponding desired dispense volume amounts.

9. The method of claim 6, wherein the test dispense system is configured to approximate a semiconductor manufacturing wafer coating system.

10. The method of claim 6, wherein the one or more test pump tubes in the test dispense system comprise:

a first length of tubing connected between an outlet port of a multi-stage pump and an outlet valve; and a second length of tubing connected between the outlet valve and a nozzle.

11. The method of claim 10, wherein the first length of tubing is 3-6 meters long having an outer diameter of 5-6.5 mm and an inner diameter of 4-4.5 millimeters and the second length of tubing is 1-1.5 meters long having an outer diameter of 3.5-4.5 mm and an inner diameter of 1.5-2.5 mm.

12. The method of claim 6, wherein the correlation is developed using the test pump and the correlation is propagated to set of pumps for subsequent use, wherein the set of pumps comprises the dispense pump.

13. The method of claim 1, wherein the fluid property is viscosity.

14. A method for compensating for system compliance in a dispense operation performed by a pump comprising:

with a test pump installed in a test dispense system that comprises at least a test pump controller, the test pump, and one or more test pump tubes downstream of the test pump;

the test pump controller performing a set of test dispenses with corresponding desired dispense volume amounts with a set of test fluids having various values for a fluid property, wherein the test pump controller is operable to control operation of the test pump;

the test pump controller analyzing a set of actual dispense volume amounts of the test dispenses relative to the desired dispense volume amounts to determine a correlation between the fluid property and the error volume, wherein the correlation that accounts for compliance in the test dispense system, wherein the compliance comprises compliance of the test pump and compliance of the one or more test pump tubes;

with a pump installed in a dispense system in a semiconductor manufacturing facility, wherein the dispense system comprises a pump controller, the pump, and one or more tubes downstream of the pump:

the pump controller determining a desired manufacturing process dispense volume amount based on a dispense recipe for dispensing a process fluid, wherein the pump controller is operable to control operation of the pump;

the pump controller determining a fluid property value for a process fluid based on the dispense recipe;

the pump controller determining an error volume amount based on the fluid property value for the process fluid from the correlation between the fluid property and the error volume; and the pump controller controlling a dispense motor to move a piston to a position to account for the desired manufacturing process dispense volume amount determined from the recipe and the error volume amount to dispense the dispense volume amount of fluid from a nozzle to a wafer.

15. The method of claim 14, wherein the pump controller controlling the dispense motor further comprises the pump controller controlling the dispense motor to move the piston to the position in a time specified by the recipe to dispense the dispense volume amount.

16. The method of claim 14, further comprising the pump controller receiving a user specified error volume that accounts for a difference between the test dispense system and the dispense system.

17. The method of claim 16, wherein the position to further accounts for the user specified error volume.

18. The method of claim 17, wherein the pump controller controlling the dispense motor further comprises the pump controller controlling the dispense motor to move the piston to the position in a time specified by the recipe to dispense the dispense volume amount.

19. The method of claim 14, wherein the test pump controller performing a set of test dispenses and analyzing as set of actual dispense volume amounts further comprise:

a) the test pump controller performing test dispenses with a corresponding desired dispense volume amount with a selected test fluid from the set of test fluids;

b) the test pump controller determining an average actual dispense volume amount;

c) the test pump controller repeating steps a-b for each of a set of additional desired dispense volume amounts;

d) the test pump controller repeating steps a-c selecting a new test fluid as the selected test fluid from the set of test fluids, wherein each test fluid has a different value for the fluid property;

e) the test pump controller determining the correlation between error volume and the fluid property based on the average actual dispense volume amounts and the corresponding desired dispense volume amounts.

20. The method of claim 14, wherein the test dispense system is configured to approximate a semiconductor manufacturing wafer coating system.

21. The method of claim 20, wherein the one or more test pump tubes in the test dispense system comprise:

a first length of tubing connected between an outlet port of the test pump and an outlet valve; and a second length of tubing connected between the outlet valve and a test nozzle.

22. The method of claim 21, wherein the first length of tubing is 3-6 meters long having an outer diameter of 5-6.5 mm and an inner diameter of 4-4.5 millimeters and the second length of tubing is 1-1.5 meters long having an outer diameter of 3.5-4.5 mm and an inner diameter of 1.5-2.5 mm.

23. The method of claim 14, further comprising propagating the correlation developed using the test pump to a set of pumps for subsequent use, wherein the set of pumps comprises the dispense pump, wherein the test dispense system is configured to simulate the dispense system.

24. The method of claim 14, wherein the fluid property is viscosity.

25. The method of claim 14, further comprising installing the test pump as the pump installed in the semiconductor manufacturing facility.

* * * * *

UNITED STATES PATENT AND TRADEMARK OFFICE

CERTIFICATE OF CORRECTION

PATENT NO. : 7,897,196 B2
APPLICATION NO. : 11/602507
DATED : March 1, 2011
INVENTOR(S) : James Cedrone and George Gonnella It is certified that error appears in the above-identified patent and that said Letters Patent is hereby corrected as shown below:

Col. 20, lines 35-36, replace “the error volume” with --an error volume--

Col. 21, line 67 – Col. 22, line 1, replace “the error volume” with --an error volume--

Signed and Sealed this
Thirty-first Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,897,196 B2
APPLICATION NO. : 11/602507
DATED : March 1, 2011
INVENTOR(S) : James Cedrone and George Gonnella It is certified that error appears in the above-identified patent and that said Letters Patent is hereby corrected as shown below:

Col. 22, line 1, delete the word "that" after the word "correlation"

Col. 22, line 36, delete the word "to" after the word "position"

Col. 22, line 44, replace "analyzing as set" with -- analyzing a set --

Signed and Sealed this
Nineteenth Day of February, 2013

Teresa Stanek Rea

Teresa Stanek Rea
*Acting Director of the United States Patent and Trademark Office*